US007648343B2

(12) United States Patent
Cornwell

(10) Patent No.: US 7,648,343 B2
(45) Date of Patent: Jan. 19, 2010

(54) AIR COMPRESSOR UNIT INLET CONTROL METHOD

(76) Inventor: James P. Cornwell, 8710 Ennis Ave., Erie, PA (US) 16509

( * ) Notice: Subject to any disclaimer, the term of this patent is extended or adjusted under 35 U.S.C. 154(b) by 251 days.

(21) Appl. No.: 11/548,724

(22) Filed: Oct. 12, 2006

(65) Prior Publication Data

US 2007/0154335 A1 Jul. 5, 2007

Related U.S. Application Data

(62) Division of application No. 10/346,145, filed on Jan. 16, 2003, now Pat. No. 7,153,106.

(51) Int. Cl.
*F04B 49/22* (2006.01)

(52) U.S. Cl. ..... 417/53; 417/278; 417/298; 417/441

(58) Field of Classification Search ..... 417/26, 417/53, 278, 295, 298, 441, 442
See application file for complete search history.

(56) References Cited

U.S. PATENT DOCUMENTS

| | | | | |
|---|---|---|---|---|
| 2,561,009 | A | | 7/1951 | Byers et al. |
| 2,804,878 | A | | 9/1957 | Fishwood et al. |
| 3,091,077 | A | | 5/1963 | Erickson et al. |
| 3,104,520 | A | | 9/1963 | Cazier et al. |
| 3,195,805 | A | | 7/1965 | Cholvin et al. |
| 3,196,606 | A | | 7/1965 | Cholvin et al. |
| 3,366,066 | A | | 1/1968 | Levy |
| 3,418,937 | A | | 12/1968 | Cardillo et al. |
| 3,812,942 | A | | 5/1974 | Espenschied et al. |
| 3,866,637 | A | | 2/1975 | Swain et al. |
| 3,874,828 | A | | 4/1975 | Herschler et al. |
| 3,961,748 | A | | 6/1976 | McNabney |
| 4,005,578 | A | | 2/1977 | McInerney |
| 4,005,579 | A | | 2/1977 | Lloyd |
| 4,060,340 | A | | 11/1977 | Yanik et al. |
| 4,089,623 | A | * | 5/1978 | Hofmann, Jr. ..... 417/295 |
| 4,256,019 | A | | 3/1981 | Braddick |
| 4,362,475 | A | | 12/1982 | Seitz |
| 4,391,184 | A | | 7/1983 | Yamane et al. |
| 4,396,345 | A | | 8/1983 | Hutchinson |
| 4,432,698 | A | * | 2/1984 | Shirakuma et al. ..... 417/27 |
| 4,480,654 | A | * | 11/1984 | Firey ..... 137/119.09 |
| 4,505,122 | A | | 3/1985 | Inomata |
| 4,514,985 | A | | 5/1985 | Cadeddu |
| 4,519,750 | A | | 5/1985 | Kurahashi et al. |
| 5,101,857 | A | | 4/1992 | Heger et al. |

(Continued)

FOREIGN PATENT DOCUMENTS

| | | |
|---|---|---|
| GB | 588521 | 5/1947 |
| GB | 760962 | 11/1956 |
| GB | 1038017 | 8/1966 |

*Primary Examiner*—Charles G Freay

(57) ABSTRACT

A method allows for controlling the amount of electric current from an electrical circuit used by an electric motor in an electric motor driven reciprocating air compressor unit. A piston is reciprocated with a portable electric motor while air is channeled through an inlet into a compression cylinder, allowing the piston to draw on compressed amounts of air during each reciprocation. A valve mechanism is mounted to the inlet and is adjustable to a plurality of positions, each position allowing for one of a plurality of predeterminable amounts of air to be permitted to be drawn into the compression cylinder and compressed. The valve mechanism is manually adjusted to control the amount of air drawn into the compression cylinder and compressed by the piston to control the amount of electric current used by the electric motor.

37 Claims, 20 Drawing Sheets

U.S. PATENT DOCUMENTS

| | | | | |
|---|---|---|---|---|
| 5,138,838 | A | | 8/1992 | Crosser |
| 5,257,646 | A | | 11/1993 | Meyer |
| 5,388,967 | A | | 2/1995 | Firnhaber et al. |
| 5,456,581 | A | | 10/1995 | Jokela |
| 5,456,582 | A | | 10/1995 | Firnhaber |
| 5,540,558 | A | | 7/1996 | Harden |
| 5,556,271 | A | | 9/1996 | Zuercher et al. |
| 5,613,837 | A | | 3/1997 | Konishi et al. |
| 5,630,706 | A | | 5/1997 | Yang |
| 5,655,887 | A | | 8/1997 | Chou |
| 5,664,938 | A | | 9/1997 | Yang |
| 5,681,151 | A | | 10/1997 | Wood |
| 5,692,540 | A | | 12/1997 | Huang |
| 5,715,681 | A | | 2/1998 | Williamson |
| 5,785,081 | A | | 7/1998 | Krawczyk et al. |
| 5,803,715 | A | | 9/1998 | Kitchener |
| 5,875,815 | A | | 3/1999 | Ungerecht et al. |
| RE36,281 | E | | 8/1999 | Zuercher et al. |
| 5,947,711 | A | | 9/1999 | Myers et al. |
| 6,056,516 | A | * | 5/2000 | Schonfeld et al. ..... 417/286 |
| 6,068,447 | A | | 5/2000 | Foege |
| 6,336,797 | B1 | | 1/2002 | Kazakis et al. |

* cited by examiner

HIGH

MED

LOW

HIGH

MED

LOW

HIGH

MED

LOW

HIGH

MED

LOW

HIGH

MED

LOW

AIR COMPRESSOR UNIT INLET CONTROL METHOD

This is a divisional application of U.S. application Ser. No. 10/346,145 filed Jan. 16, 2003 now U.S. Pat. No. 7,153,106 and which is incorporated herein by reference.

BACKGROUND

Portable reciprocating air compressor units are commonly used in a variety of applications where it is necessary to convert electrical current into mechanical energy in the form of pneumatic pressure. Due to their portability and relative efficiency, such compressor units are highly practical for use in industrial, construction and maintenance, commercial, farming, or similar settings where electrical circuits are available and where large amounts of mechanical energy are needed. Portable compressor units are also used widely by consumers in home workshops, garages and for remodeling projects. Nail guns, staplers, paint spraying equipment, caulking guns, impact wrenches, and sanding equipment are examples of the types of tools that can run on compressed air supplied by a portable reciprocating air compressor unit.

Such compressor units are generally rated to draw specific levels of electrical current from the electrical circuits to which they are connected during operation. However, the size or power of a compressor unit that can be connected to a given electrical circuit can be limited by the current capacity of the circuit. This is especially true where multiple apparatuses are to be connected to a single compressor unit for simultaneous operation or where multiple air compressor units or a combination of air compressor units and other types of electrically-driven equipment must be connected to a single circuit leg and must each draw electrical current from the same circuit simultaneously.

Due to their portability, such air compressor units are often chosen so that one compressor can be used for multiple types of applications. However, different applications can require significantly different levels of energy from a compressor unit. The use of a smaller or less powerful compressor unit can result in an insufficient amount of pneumatic energy being available for larger or heavier duty applications. Conversely, a larger or more powerful compressor unit can, in addition to exceeding the current capacity of the connected electrical circuit, require an amount of energy to operate that is far in excess of what is necessary for lighter duty applications.

Even if the connected electrical circuit has a sufficiently large current capacity to operate larger, more powerful, or multiple compressor units, the use of such compressor units or equipment combinations may make it impossible to simultaneously run additional electrically-operated equipment from the same electrical circuit. This is due to the fact that the combination of the one or more compressor units and additional electrically operated equipment may surpass the current capacity of the electrical circuit. Thus, it may be necessary for a user to employ multiple air compressor units that are appropriate for different circumstances or to have multiple air compressor units in the user's inventory which require different levels of electrical current for operation.

SUMMARY

The invention is a portable electric motor driven reciprocating air compressor unit and a method for controlling the amount of electricity that the compressor unit uses. The compressor unit has a compression cylinder having a piston that reciprocates along the length of the cylinder. The piston is driven by an electric motor that is attached to an electrical circuit having a predeterminable current capacity. An inlet allows for the channeling of air into the compression cylinder.

A manually controllable valve mechanism is mounted to the inlet and has a plurality of positions. Each position of the valve mechanism allows for one of a plurality of amounts of air to flow through the inlet during each reciprocation of the piston. The valve mechanism is manually controllable in that movement of the valve mechanism to different positions requires the operator to undertake to change the position of the valve by hand, mechanical, electronic or other direct means, i.e. the position of the valve mechanism can be changed only with the outside instruction or logic of the operator. The position of the valve mechanism does not change automatically as a result of the operation of the compressor unit or its load.

The manually controllable valve mechanism controls the amount of air that the piston can draw into the compressor with each reciprocation. The amount of electric current used by the electric motor to drive the piston depends on the amount of air that is compressed. When the valve mechanism is adjusted to a position that reduces the total amount of air that is able to flow through the inlet during a reciprocation, less electric current is used by the electric motor.

In the event that an air compressor unit is designed to operate with a larger current than is available through an existing electrical circuit or if multiple compressor units are to be connected to a single circuit and the total current they draw during operation exceeds the total current capacity of the circuit, or if an air compressor unit is to operate on an electrical circuit with other electrically powered devices and together the air compressor unit and other devices overload the circuit, the manually controllable valve mechanism on an air compressor unit can be adjusted to a position that will reduce the amount of air flowing through the inlet during each reciprocation. Since this will result in less electrical current being used by that compressor unit, the invention can eliminate the need to modify the electrical circuit, to use a smaller capacity compressor unit, or to remove one or more electrically powered devices from the electrical circuit where multiple devices are connected to the same circuit. In some applications, the number of electrically powered devices connected to the same circuit can actually be increased.

Those skilled in the art will realize that this invention is capable of embodiments that are different from those shown and that details of the structure of the disclosed air compressor unit inlet control can be changed in various manners without departing from the scope of this invention. Accordingly, the drawings and descriptions are to be regarded as including such equivalent air compressor unit inlet controls as do not depart from the spirit and scope of the invention.

BRIEF DESCRIPTION OF THE DRAWINGS

For a more complete understanding and appreciation of this invention and many of its advantages, reference should be made to the following, detailed description taken in conjunction with the accompanying drawings wherein.

DETAILED DESCRIPTION

Figure 1:
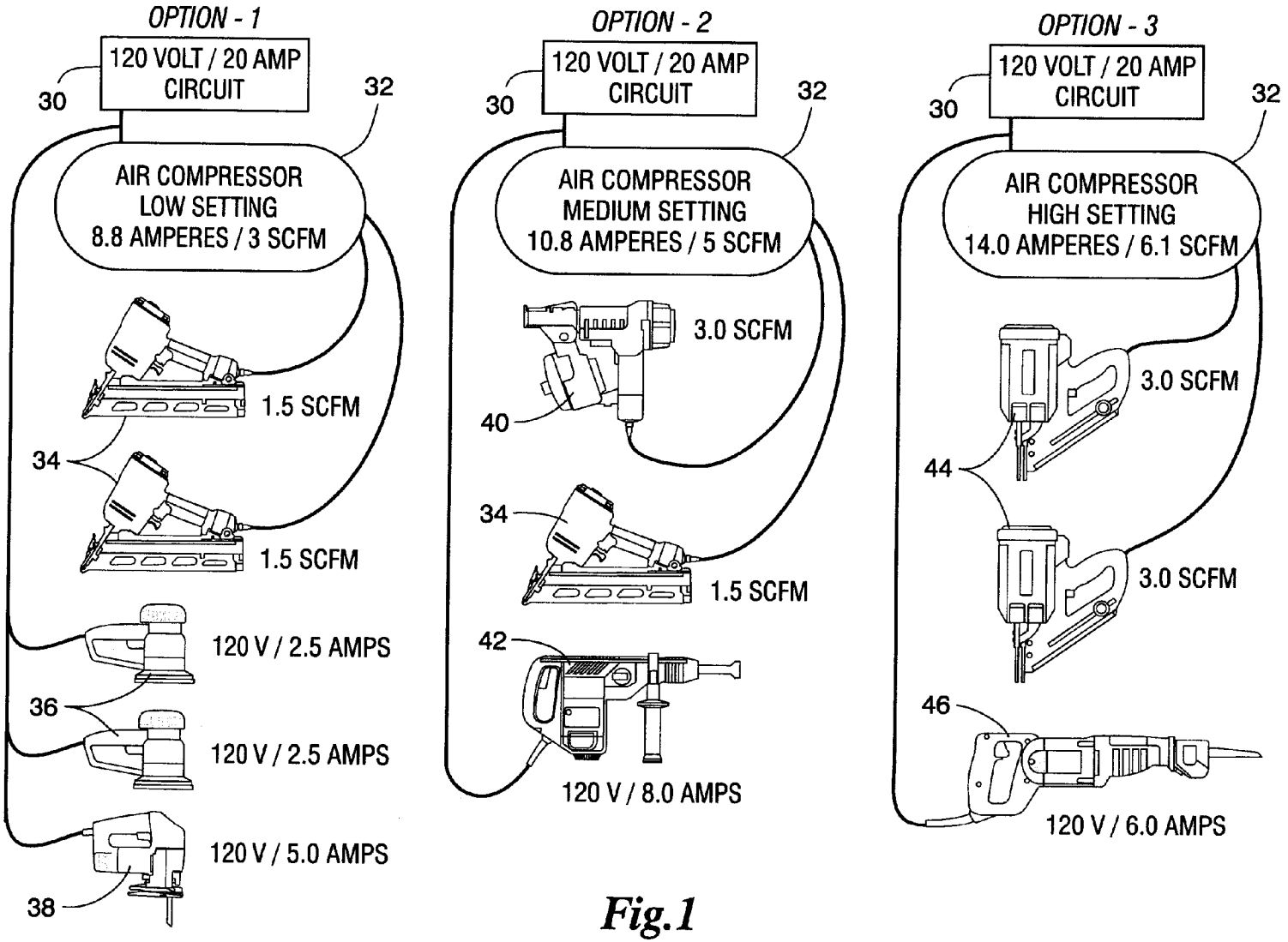
FIG. 1 depicts examples of possible device combinations that are possible for connection to a common electrical circuit while using an embodiment of the invention.

Referring to the drawings, similar reference numerals are used to designate the same or corresponding parts throughout the several embodiments and figures. In some drawings, some specific embodiment variations in corresponding parts are denoted with the addition of lower case letters to reference numerals. For simplification of understanding, operational examples of the invention assume standard operating conditions of atmospheric pressure at sea level (approximately 14.7 PSI) and an environmental temperature of approximately 68 degrees Fahrenheit (20 degrees Celsius).

FIG. 1 depicts an illustrative example of three possible device combinations any one of the combinations being connectable to a typical 120V electrical circuit 30 that is rated to have a current capacity of 20 Amps for operation. Thus, during use, the combined and simultaneous current draw of the devices included in any one of the three illustrated options that is connected to draw from the circuit 30 must not exceed 20 Amps in total.

An air compressor unit 32 is among the devices that are connected to the electrical circuit 30 in each illustrated option of FIG. 1. One compressor unit 32 that could be appropriately used in this example would be a Contractor Series, model WL506206AJ air compressor available from Campbell Hausfeld, which is a hand-held, twin reservoir, and direct drive compressor unit having a delivery rating of 6.1 SCFM at 90 PSI and having a 3 H.P. peak electric motor rated to run up to 14 Amps. Other compressor units, such as the wheeled single reservoir compressor units depicted in the various figures, can also be used.

In FIG. 1, consider option-1 in which the air compressor unit 32 operates at a LOW setting drawing 8.8 Amps in order to provide 3 SCFM total air volume output necessary to operate two pneumatically driven finish nailers 34, each finish nailer 34 requiring 1.5 SCFM for operation. In this configuration, the level of current consumption by the air compressor unit 32 leaves approximately 11.2 Amps of current capacity available for consumption by the remaining devices that are connected to the circuit 30 to draw upon. As depicted by option-1, two pad sanders 36, each drawing 2.5 Amps, and a jig saw 38, drawing 5.0 Amps, can be run simultaneously with the air compressor unit 32 operating at 8.8 Amps on the circuit 30 without exceeding the 20 Amps of total current draw that is allowed.

Now consider option-2 as depicted in FIG. 1. In order to provide sufficient total air volume output for the simultaneous operation of a roofing nailer 40, requiring 3.0 SCFM, and a finish nailer 34, requiring 1.5 SCFM, it is necessary for the same air compressor unit 32 to provide a total of 5.0 SCFM. It is therefore necessary for the air compressor unit 32 to operate at a MEDIUM setting with a current draw of 10.8 Amps from the circuit 30. This leaves approximately 9.2 Amps of current capacity for remaining devices that are connected to the circuit 30 to draw upon. As depicted, this is still sufficient to allow for the simultaneous operation of a hammer drill 42 that operates with a current draw of 8.0 Amps without exceeding 20 Amps of current draw on the circuit 30.

Now consider option-3 as depicted in FIG. 1. In order to provide sufficient total air volume output for the simultaneous operation of two framing nailers 44, each requiring 3.0 SCFM for operation, it is necessary for the same air compressor unit 32 to provide a total of 6.1 SCFM. It is therefore necessary for the air compressor unit 32 to operate at a HIGH setting with a current draw of 14.0 Amps from the circuit 30. This leaves approximately 6.0 Amps of current capacity for remaining devices that are connected to the circuit 30 to draw upon. As depicted, this is still sufficient to allow for the simultaneous operation of a sawzall 46 that operates with a current draw of 6.0 Amps without exceeding 20 Amps of current draw on the circuit 30.

Comparing the examples of option-1, option-2 and option-3, it follows that where a circuit has a given current capacity, a reduction in the amount of current that a connected reciprocating compressor unit draws from the circuit during operation allows for an approximately equal increase in the amount of remaining current capacity that is available to power other devices connected to the circuit. Likewise, if a given compressor unit is designed to operate with a current draw that exceeds the current capacity of a given electrical circuit, the compressor unit must have the capability to also operate with a lower current draw that is below the capacity of the given circuit if the same circuit is to be used to power the compressor unit.

However, the total number and variety of pneumatically powered devices that can be operated with a given compressor unit, as represented by the particular compressor unit output requirement (in SCFM) of the combined devices, will depend on the electrical current draw that the given compressor unit requires to generate the particular output requirement. Thus, in many applications, it is either advantageous or necessary to be able to minimize the current draw of a compressor unit to a level that, while sufficiently large to allow the compressor unit to produce an output level that will run each attached pneumatic device, remains sufficiently small to remain within the current capacity limitation of the connected electrical circuit or to maximize the remaining available capacity of the circuit to allow for the powering of additional electrical devices.

Figure 2:
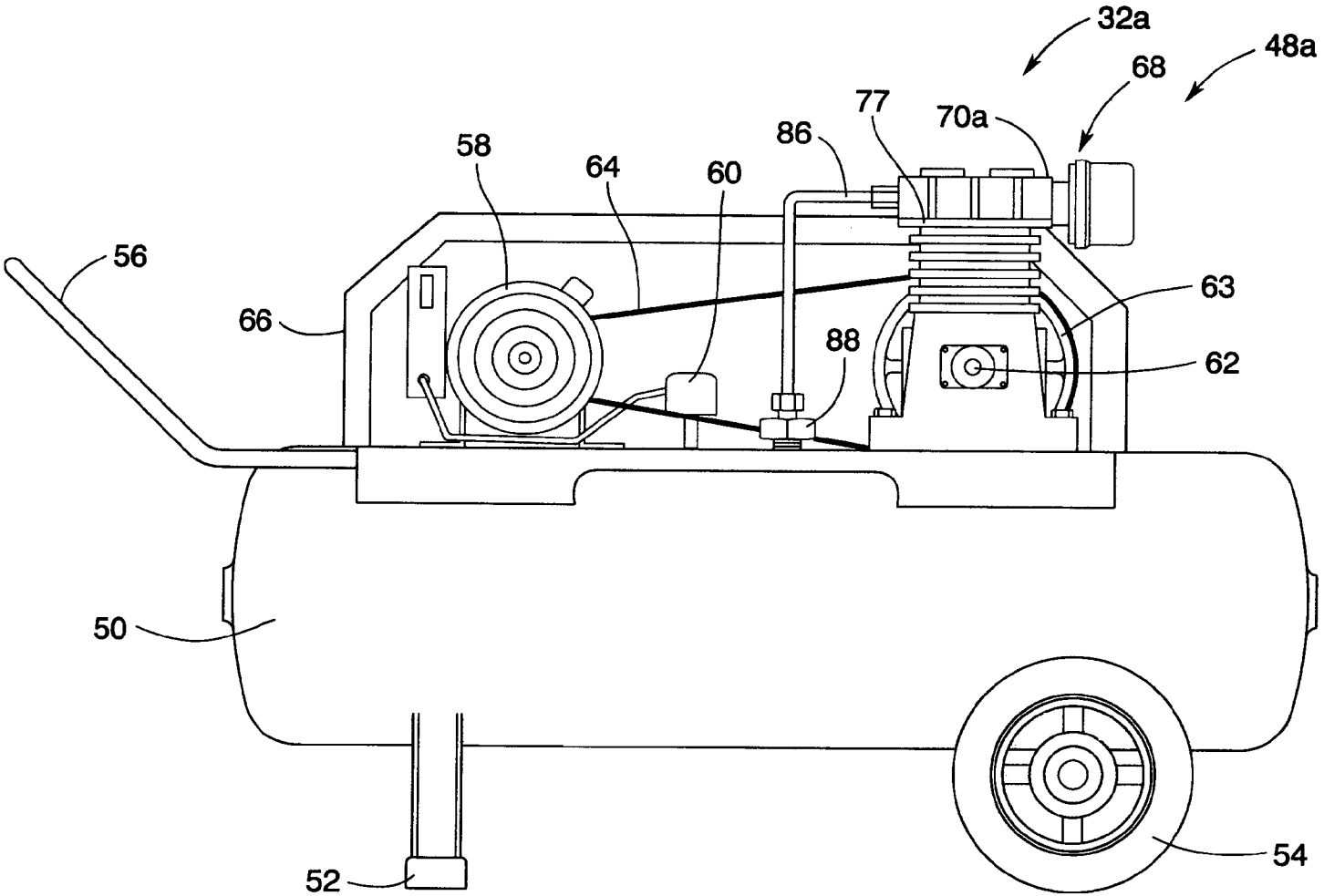
FIG. 2 is a side view of a portable electric motor driven reciprocating air compressor unit according to one embodiment of the invention.

FIG. 2 depicts a typical wheeled portable reciprocating air compressor unit 32*a*. The compressor unit 32*a* includes a compressor pump 48*a* mounted on an air reservoir 50 which forms a structural chassis to support the various components of the compressor unit 32*a*. The compressor unit 32*a* is supported with one or more legs 52 and wheels 54 that are positioned near the ends of the air reservoir 50. A handle 56 allows one end of the compressor unit 32*a* to be lifted off of its legs 52 to enable the compressor unit 32 to be moved about on its wheels 54.

An electric motor 58 and pressure switch 60 are also mounted on the air reservoir 50. The electric motor 58 is connected to draw electrical current from an electrical circuit (not shown) when the pressure switch 60 assumes an ON position. When the pressure switch 60 assumes an ON position, the motor 58 drives a pulley 63 connected to a crankshaft 62 on the compressor pump 48*a* with a drive belt 64. The pressure switch 60 is configured to be responsive to air pressure within the air reservoir 50 and to allow operation of the electric motor 58 when the magnitude of the pressure within the air reservoir 50 falls below a predetermined magnitude. A screen guard 66 encloses the electric motor 58, drive belt 64, and pressure switch 60, and partially encloses the compressor pump 48*a*.

Although FIG. 2 depicts an air compressor unit 32*a* having basic compressor components arranged in a typical single reservoir configuration, it will be appreciated that other portable compressor unit configurations are also possible. Such compressor units include those having upright standing, pancake, spherical or multiple air reservoirs and/or liftable, all legged, trailered, wheelbarrow, or sliding chassis configurations. Other similar variations are also possible and are contemplated to be included within the types of portable reciprocating air compressor units that are suitable for use with the invention.

Figure 3:
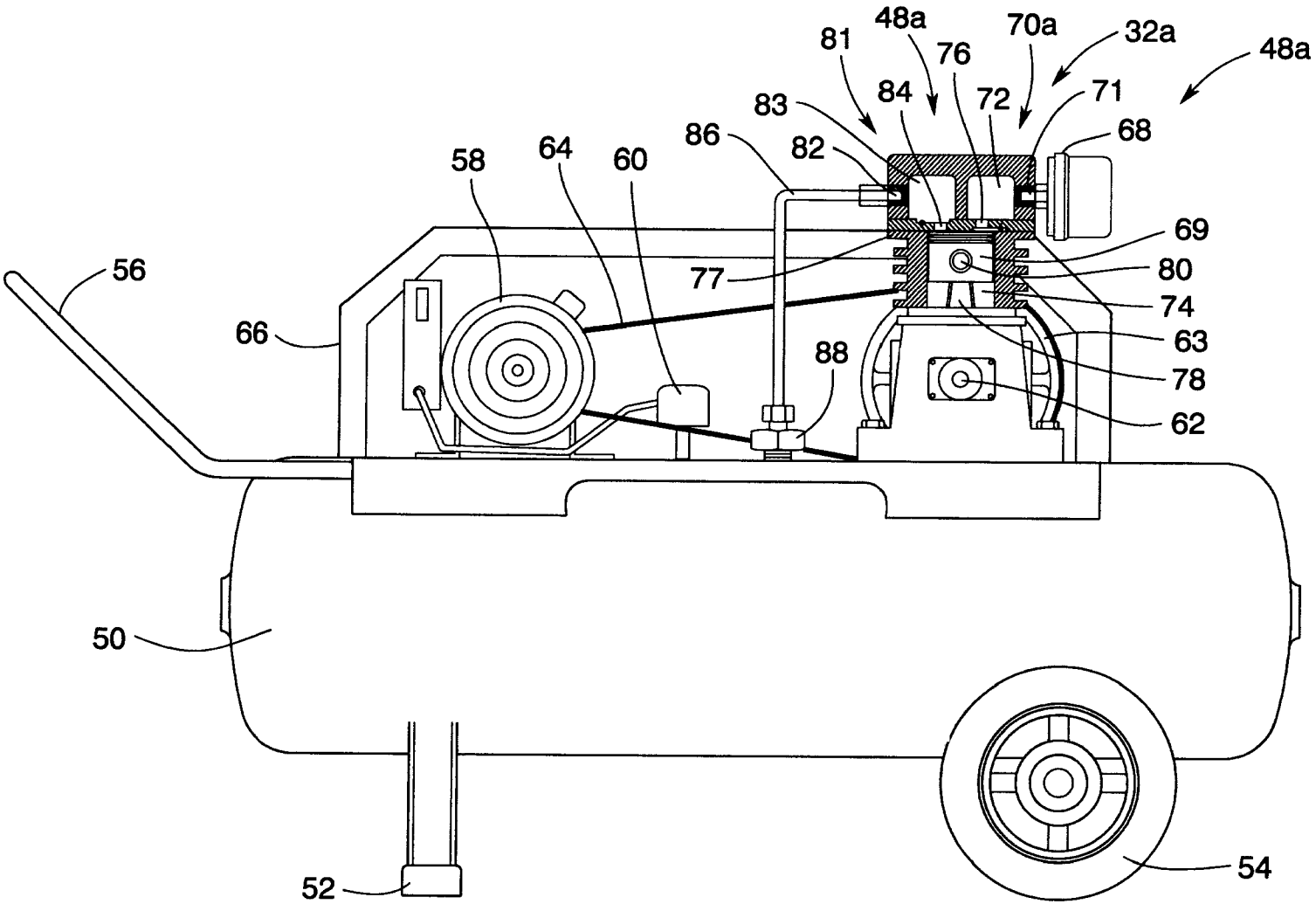
FIG. 3 is a partial cross sectional side view of the compressor unit of FIG. 2.

FIG. 3 is a partial cross sectional view of the compressor unit 32*a* of FIG. 2 depicting a number of internal components of the compressor pump 48*a* and their relation to the rest of the compressor unit 32*a*. A magnified cross sectional view of these internal components within the compressor pump 48*a* is depicted in FIG. 4.

Figure 4:
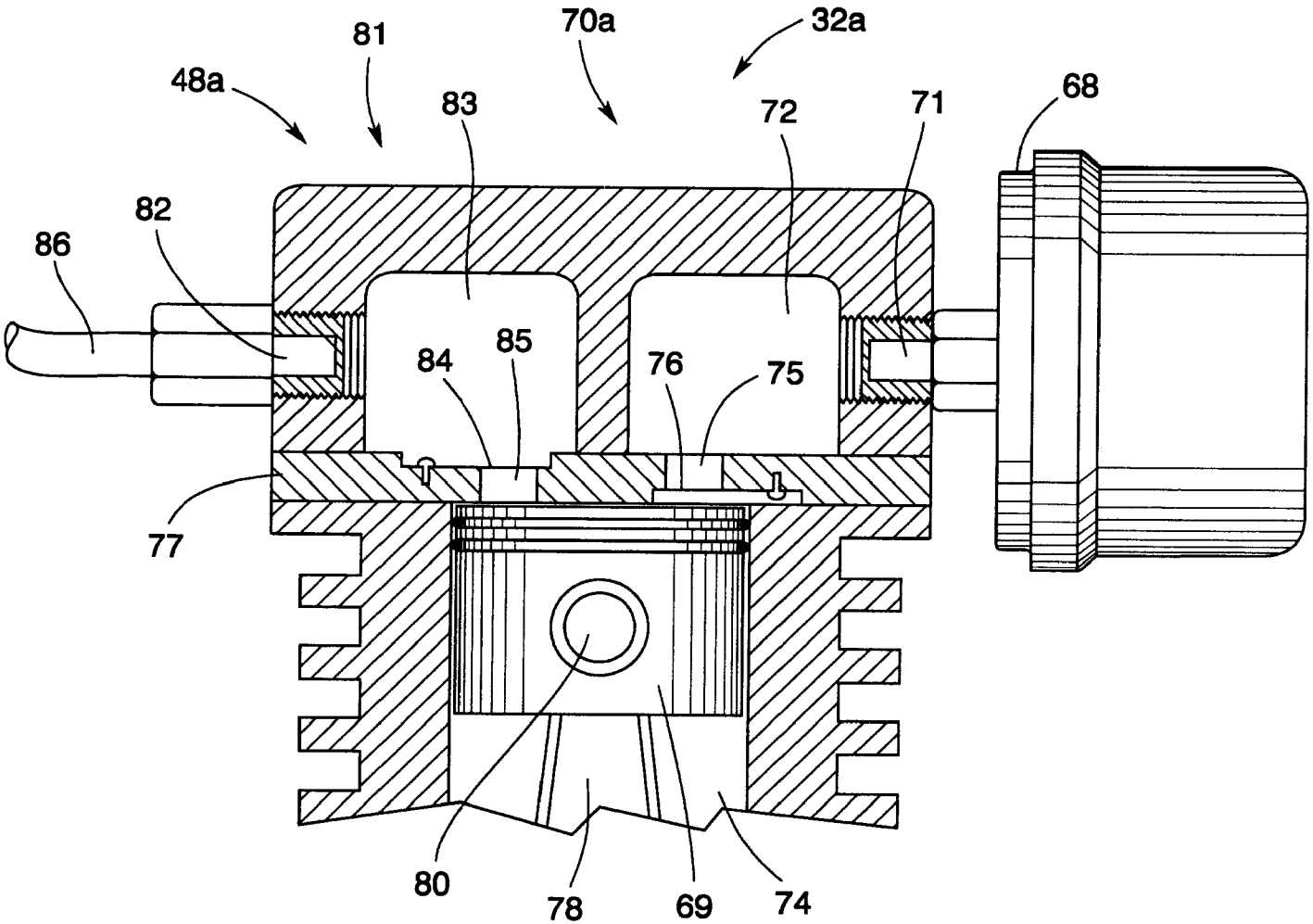
FIG. 4 is a magnified cross sectional view of the inlet, compression cylinder, and outlet of the compressor unit of FIG. 2.

Referring to FIGS. 3 and 4, a manually controllable valve mechanism 68 is positioned at an inlet 70*a*. The valve mechanism 68 and inlet 70*a* allow air to enter the compressor pump 48*a* from the environment. The valve 68 can be adjusted by hand to control the amount of air that enters the compressor pump 48*a* during each reciprocation of a piston 69 that is located within a compression cylinder 74. The inlet 70*a* includes an inlet port 71 to channel air from the valve mechanism 68 into an inlet chamber 72 which receives air before the air is channeled into the compression cylinder 74 through an inlet valve 76 located in an inlet hole 76. The inlet hole 75 and inlet valve 76 can be included as part of a valve plate 77 that is positioned between the inlet chamber 72 and compression cylinder 74. The inlet valve 76 is unidirectional in that it only allows air to flow through the inlet hole 75 from the inlet chamber 72 when, during an intake stroke (downward as depicted in FIGS. 3 and 4) of the piston 69, the piston 69 draws air into the compression cylinder 74. During a compression stroke (upward as depicted in FIGS. 3 and 4) of the piston 69, the inlet valve 76 closes to prevent air from flowing from the compression cylinder 74, through the inlet hole 75 and back into and through the inlet chamber 72.

The electric motor 58 effects reciprocation of the piston 69 by turning the pulley 63 and crankshaft 62 of the compressor pump 48 with the drive belt 64. The crankshaft 62 in turn causes reciprocation of a piston shaft 78 which drives the piston 69, the piston shaft 78 being connected to the piston 69 with a piston pin 80. The amount of electric current that the motor 58 draws from the electrical circuit depends on the amount of air that is drawn through the inlet 70 during each reciprocation of the piston 69. This is due to the fact that the amount of air that is drawn through the inlet 70 ultimately determines the amount of air that the piston 69 can draw into the compression cylinder 74 and compress during each reciprocation. This in turn determines the amount of energy that the motor 58 must exert to run the compressor unit 32*a*, causing the motor 58 to draw an amount of electric current from the electrical circuit that is dependent on the amount of air that is permitted to pass through the valve mechanism 68. Therefore, adjustment of the valve mechanism 68 has the effect of changing the amount of air that is compressed and changing the amount of electric current drawn from the electrical circuit during each reciprocation of the piston 69.

An outlet 81 is positioned to receive air that has been compressed in the compression cylinder 74 and to channel air from the compression cylinder 74 out of the compressor pump 48*a* during each compression stroke of the piston 69. The outlet 81 includes an outlet chamber 83 for receiving air that has been compressed in the compression cylinder 74, an outlet port 82, and a unidirectional outlet valve 84 located in an outlet hole 86 for channeling air into the outlet chamber 83. The outlet hole 85 and outlet valve 84 can be included as part of the valve plate 77 that is positioned between the compression cylinder 74 and outlet chamber 83. The outlet valve 84 is unidirectional in that it only allows air to flow through the outlet hole 85 and into the outlet chamber 83 when, during a compression stroke of the piston 69, the piston 69 expels air from the compression cylinder 74. During an intake stroke of the piston 69, the outlet valve 84 closes to prevent air from flowing from the outlet chamber 83 back through the outlet hole 84 and into the compression cylinder 74.

Referring now to FIG. 2, a discharge tube 86 is connected to the outlet port 82 to channel compressed air from the compressor pump 48*a* to the air reservoir 50. A check valve 88 is positioned at the end of the discharge tube 86 to allow air to flow from the discharge tube 86 into the air reservoir 50 while preventing backflow from the reservoir 50 into the discharge tube 86 and to prevent loss of air pressure from within the reservoir 50.

The pressure switch 60 is connected to the electrical circuit and to the electric motor 58 and is mounted at a location that allows the pressure switch 60 to sense the pressure of air contained within the air reservoir 50. As air is forced into the air reservoir 50, pressure in the air reservoir 50 increases. When the air pressure within the reservoir 50 reaches a predetermined maximum magnitude of pressurization, the pressure switch 60 assumes an OFF position since additional air compression is not necessary. Once the air pressure within the reservoir 50 falls below a minimum predetermined magnitude, the pressure switch 60 assumes an ON position, allowing the motor 58 to draw current from the electrical circuit and causing the compressor pump 48*a* to add compressed air to the reservoir 50 until the air pressure within the reservoir 50 rises to the predetermined maximum magnitude that is larger than the predetermined minimum magnitude at which time the pressure switch 60 returns to an OFF position. However, the amount of air that is compressed, and consequently the amount of electric current used by the motor 58 with each reciprocation of the piston 49, will continue to depend on the amount of air that is permitted to enter the inlet 70*a* with the manually controllable valve mechanism 68.

To better understand how the valve mechanism 68 controls the amount of electrical current used by the motor 58, again consider the three example options depicted in FIG. 1. Assume that the compressor unit 32*a* of FIGS. 2-4 also represents the compressor unit 32 shown in FIG. 1. According to option-1, the air compressor unit 32*a* operates at a LOW setting to provide 3.0 SCFM total air volume output which is sufficient to operate two finish nailers 34 each requiring 1.5 SCFM. The motor 58 reciprocates the piston 69 within the compression cylinder 74 as air is channeled into the compression cylinder 74 through the inlet 70*a*, the piston 69 drawing an amount of air into the compression cylinder 74 during each intake stroke and then compressing the amount of air during each compression stroke. When the compressor unit 32*a* is set at the LOW setting of option-1, it is determined that the valve mechanism 68 that is mounted to the inlet 70*a* is set to a position that allows a predeterminable amount of air to enter the compression cylinder 74 during each intake stroke that results in the motor 58 operating with a current draw of 8.8 Amps.

When the valve mechanism 68 is manually adjusted to set the compressor unit 32*a* to the MEDIUM setting of option-2, the valve mechanism 68 assumes a position that allows an increase in the amount of air that is drawn into the compression cylinder 74 during each intake stroke and then compressed during each compression stroke as the motor 58 reciprocates the piston 69 within the compression cylinder 74. This amount of air is sufficient for the compressor unit 32*a* to provide 5.0 SCFM total air volume output that can operate one finish nailer 34 requiring 1.5 SCFM and one roofing nailer 40 requiring 3.0 SCFM. Since more air is drawn into the compression cylinder 74 and then compressed during each reciprocation at the MEDIUM setting than at the LOW setting, the motor 58 draws more current from the electrical circuit 30. It is determined that at the MEDIUM setting, the valve mechanism 68 is set to a position that allows a predeterminable amount of air to enter the compression cylinder 74 during each intake stroke that results in the motor 58 operating with a current draw of 10.8 Amps.

When the valve mechanism 68 is manually adjusted to set the compressor unit 32*a* to the HIGH setting of option-3, the valve mechanism 68 assumes a position that allows an increase in the amount of air that is drawn into the compression cylinder 74 during each intake stroke and then compressed during each compression stroke as the motor 58 reciprocates the piston 69 within the compression cylinder 74. This amount of air is sufficient for the compressor unit 32*a* to provide 6.1 SCFM total air volume output which can operate two framing nailers 44 each requiring 3.0 SCFM. Since more air is drawn into the compression cylinder 74 and then compressed during each reciprocation at the HIGH setting than at the MEDIUM setting, the motor 58 draws more current from the electrical circuit 30. It is determined that at the HIGH setting, the valve mechanism 68 is set to a position that allows a predeterminable amount of air to enter the compression cylinder 74 during each intake stroke that results in the motor 58 operating with a current draw of 14.0 Amps.

To better understand how the invention enables the control of the amount of current that remains available for use by devices other than the compressor unit 32 that are connected to the electrical circuit 30, now consider that the current capacity of the electrical circuit 30 is to be limited to 15.0 Amps. Assume that it is necessary to keep the compressor unit 32 in operation and it must use the electrical circuit 30 for power. In such a configuration, the combined current draw of the compressor unit 32 and other devices connected to the electrical circuit 30 must be limited to a level that would be below 15.0 Amps, i.e. the combined compressor unit setting and combination of electrical devices in each of option-1, option-2, and option-3 must create a total current draw of no more than 15.0 Amps.

In option-1, this could only be accomplished by removing at least one of the electrical devices, such as the jig saw 38, or alternatively, removing both of the pad sanders 36. Since the compressor unit 32 is already set to the LOW setting, only removal of the additional electrical devices would enable the combined current draw to be below 15.0 Amps. The compressor unit 32 continues to produce 3.0 SCFM to run the two finish nailers 34 while continuing to draw 8.8 Amps at the LOW setting.

Option-2 would also require removal of a connected electrical device, in this case the hammer drill 42. Merely lowering the setting of the compressor unit 32 from the MEDIUM setting to the LOW setting (a reduction of 5.0 SCFM at 10.8 Amps to 3.0 SCFM at 8.8 Amps), in addition to disconnecting either the finish nailer 34 or roofing nailer 40, would still result in a combined current draw of 16.8 Amps by the compressor unit 32 (8.8 Amps) and hammer drill 42 (8.0 Amps). This would exceed the 15.0 Amp current capacity of the circuit 30 by 1.8 Amps.

However, option-3 would only require the compressor unit 32 to be lowered from a HIGH setting to a LOW setting (a reduction of 6.1 SCFM at 14.0 Amps to 3.0 SCFM at 8.8 Amps). Although such a reduction in the compressor setting would require the disconnection of one of the framing nailers 44 from the compressor unit 32, the combined current draw of the compressor unit 32 at the LOW setting (8.8 Amps) and sawzall 46 (6.0 Amps) would be 14.8 Amps, or 0.2 Amps less than the 15.0 Amp capacity of the circuit 30.

To better understand how the invention can be used to limit the amount of current that is used by the compressor unit 32 to a level that is below the current capacity of the electrical circuit 30, now consider the three example options depicted in FIG. 1 in which the current capacity of the electrical circuit 30 is to be limited to 10.0 Amps. Again assume that it continues to be necessary to keep the compressor unit 32 in operation and that it must use electrical circuit 30. Although the setting of the compressor unit 32 cannot be lowered in option-1 below the LOW setting, disconnecting the two pad sanders 36 (each drawing 2.5 Amps) and the jig saw 38 (drawing 5.0 Amps) from the electrical circuit 30 will continue to allow the compressor unit 32 to operate alone since the current draw of the compressor unit 32 is 8.8 Amps, or 1.2 Amps lower than the 10.0 Amp capacity of the circuit 30. The compressor unit 32 can continue to provide 3.0 SCFM to run the two finish nailers 34.

However, in option-2 and option-3, even if the hammer drill 42 or sawzall 46 are disconnected from the electrical circuit 30, the compressor unit 32 will continue to draw more current (10.8 or 14.0 Amps) than the 10.0 Amp capacity of the circuit 32 allows, as long as the compressor unit 32 continues to operate in either the MEDIUM or HIGH settings. Therefore, in addition to disconnecting the hammer drill 42 or sawzall 46, the compressor unit 32 must be set to the LOW setting to be used with the electrical circuit 32. Although lowering the setting will allow the compressor unit 32 to produce only 3.0 SCFM and therefore allow only the connection of one roofing nailer 40 (requiring 3.0 SCFM), one framing nailer 44 (requiring 3.0 SCFM), or two finish nailers 34 (each requiring 1.5 SCFM for a total of 3.0 SCFM), the compressor unit 32 will draw only 8.8 Amps and can continue to be connected to the electrical circuit 30.

It follows from the examples of option-1, option-2, and option-3 that if the amount of current that is drawn by a compressor unit from an electrical circuit can be controlled, it is also possible to control the amount of current that is available for devices other than the compressor unit that are also connected to the circuit, or alternatively, to control the number or type of devices that are also connected to the circuit. It similarly follows that if the amount of current drawn by a compressor unit can be controlled or limited, it is possible to successfully operate the compressor unit without exceeding the current capacity of a connected electrical circuit, even if the compressor unit is capable of drawing a level of current that is in excess of the current capacity of the circuit.

Figures 5A, 5B, 5C:
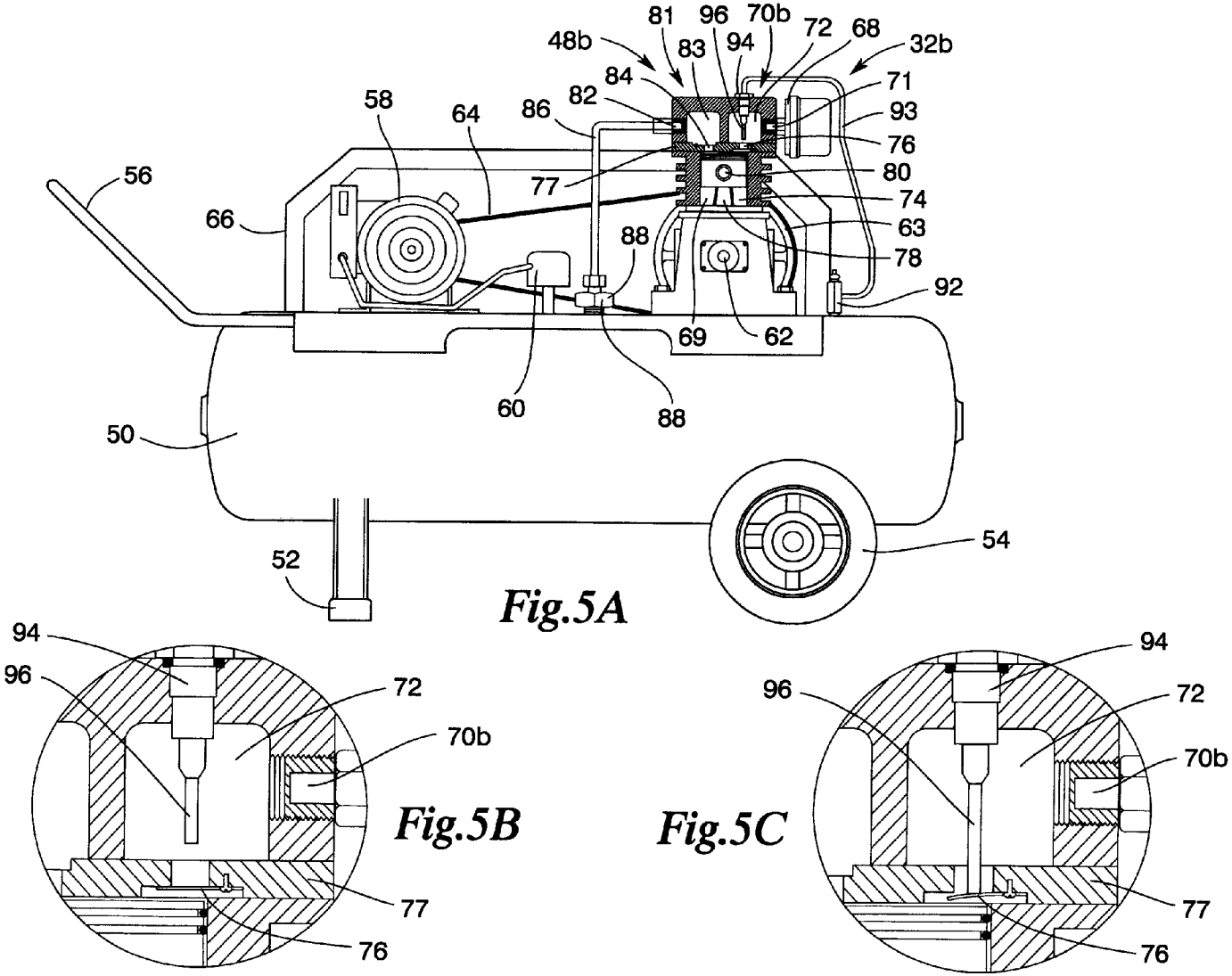
FIG. 5A is a partial cross sectional side view of a compressor unit according to one embodiment of the invention.
FIG. 5B is a magnified cross sectional side view of the compressor pump of the compressor unit of FIG. 5A having an inlet unloader that is positioned to allow compression of air.
FIG. 5C is a magnified cross sectional side view of the compressor pump of the compressor unit of FIG. 5A having an inlet unloader that is positioned to prevent compression of air.

It will be appreciated that the invention can be similarly implemented in continuously operated compressor units. Referring now to FIG. 5A, an air compressor unit 32*b* is depicted in which a pilot valve 92 takes the place of a pressure switch to enable the motor 58 to run continuously without continuously causing a compressor pump 48*b* to add compressed air to the reservoir 50. The pilot valve 92 is positioned on the reservoir 50 and is configured to be responsive to the magnitude of air pressure that is contained within the reservoir 50. The pilot valve 92 communicates pneumatically through a pilot tube 93 with an inlet unloader 94 that is positioned on the compressor pump 48*b*. The inlet unloader 94 includes an unloader pin 96 that is positioned to extend to and retract from the inlet unloader 94 to interfere with the operation of the inlet valve 76 and to prevent further reservoir pressurization when the reservoir 50 is fully pressurized to a predetermined maximum magnitude of pressurization.

Consider the air compressor unit 32*b* when, due to the usage of air pressure by devices connected to the compressor unit 32*b*, the magnitude of air pressure contained within the reservoir 50 falls below a predetermined minimum magnitude. The pilot valve 92 senses low air pressure within the reservoir 50 and assumes an OFF condition. In response, the pilot valve 92 pneumatically communicates the OFF condition to the inlet unloader 94 by removing a pneumatic pressure signal from the pilot tube 93.

Referring to the magnified cross sectional side view of the compressor pump 48*b* in FIG. 5B, the inlet unloader 94 retracts the unloader pin 96 away from the inlet valve 76, allowing the inlet valve 76 to operate to permit air to be drawn from the inlet chamber 72 through the inlet hole 76 and into the compression cylinder 74 during each intake stroke of the piston 69 while preventing air from being expelled from the compression cylinder 74 back through the inlet chamber 72 and the inlet port 71 during each compression stroke of the piston 69. The pilot valve 92 will continue to prevent the inlet unloader 94 from interfering with the inlet valve 76 as long as air pressure within the reservoir 50 remains below a predetermined maximum magnitude which is larger than the predetermined minimum magnitude. Since the motor 58 runs continuously, the amount of air that is compressed with each reciprocation of the piston 69 and the amount of electric current drawn by the motor 58 from the electrical circuit will continue to depend on the amount of air that is permitted by the manually controllable valve mechanism 68 to enter through the port 70.

Now consider, with reference to FIG. 5C, the same air compressor unit 32*b* when, due to the compression of air by the piston 69, the magnitude of air pressure contained within the reservoir 50 rises above the predetermined minimum magnitude. The pilot valve 92 continues to pneumatically communicate the OFF condition to the inlet unloader 94 until the air pressure within the reservoir 50 rises above the predetermined maximum magnitude. When the air pressure contained within the reservoir 60 rises above the predetermined maximum magnitude, the pilot valve 92 senses that the reservoir 50 is fully pressurized and assumes an ON condition. In response, the pilot valve 92 pneumatically communicates the ON condition to the inlet unloader 94 by adding a pneumatic pressure signal from the pilot tube 93. In response, the inlet unloader 94 extends the unloader pin 96 to contact the inlet valve 76 and to prevent the inlet valve 76 from closing during each compression stroke of the piston 69. Although the open inlet valve 76 allows air to be drawn from the inlet chamber 72 through the inlet hole 75 and into the compression cylinder 74 during each intake stroke of the piston 69, the piston 69 also expels air from the compression cylinder 74 back through the inlet hole 75 into inlet chamber 72, inlet port 71, valve mechanism 68 and into the environment during each compression stroke as long as the inlet unloader 94 prevents the inlet valve 76 from closing.

Although the motor 58 runs continuously, the compressor pump 48 will be prevented from adding air pressure to the reservoir 50, regardless of the amount of electric current drawn by the motor 58 from the electrical circuit or the amount of air that is permitted by the manually controllable valve mechanism 68 to enter through the inlet port 71, until the pilot valve 92 again senses that reservoir pressure is below the predetermined minimum magnitude and accordingly removes its pneumatic pressure signal from the pilot tube 93.

It will be further appreciated that many variations in the design and operation of the manually controllable valve mechanisms 68 that are used may be appropriately implemented into a compressor unit 32 without departing from the intended scope of the invention. Appropriately implemented valve mechanisms 68 can include incremental or non-incremental positions. Such appropriately implemented valve mechanisms 68 can also include manual adjustment mechanisms that are operated remotely, by hand, or with the assistance of mechanical or electronically actuated mechanisms. Thus, it is contemplated that any such manually controllable valve mechanism can be used in which the position of the valve is changed by direct means as a result of the outside logic or instruction of the operator, i.e. not automatically as a result of the operation of the compressor unit or its load.

Figure 6:
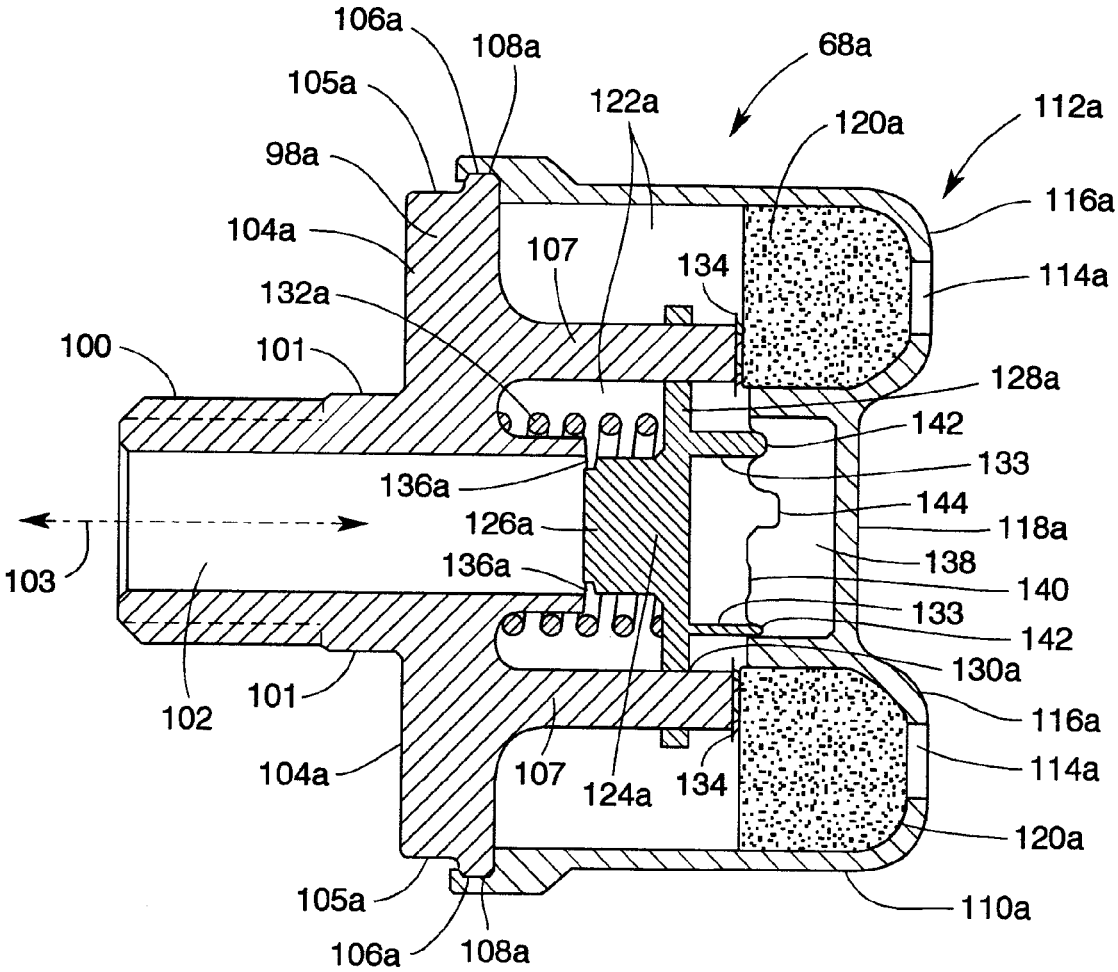
FIG. 6 is a cross sectional side view of a manually controllable valve mechanism according to one embodiment of the invention.
Figure 7:
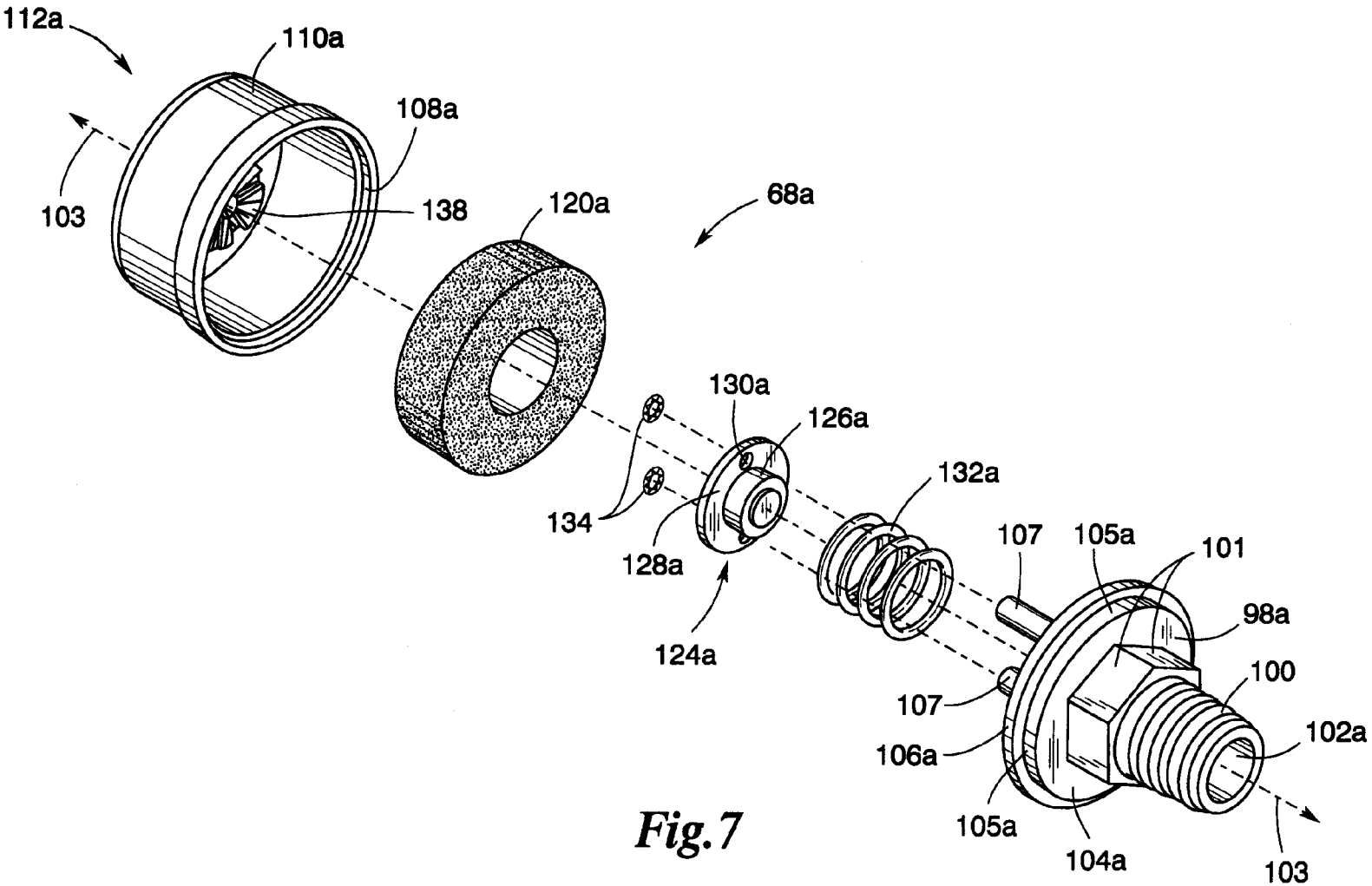
FIG. 7 is an exploded perspective view of the valve mechanism of FIG. 6.
Figure 8A:
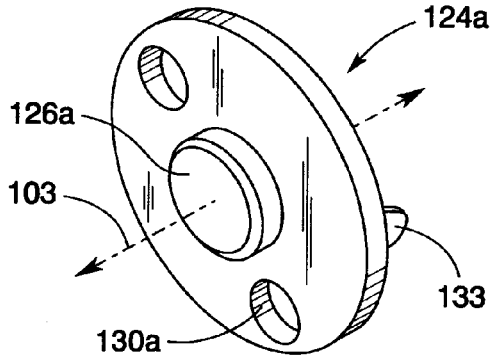
FIG. 8A is perspective view of a piston as included in the valve mechanism of FIG. 6.
Figure 8B:
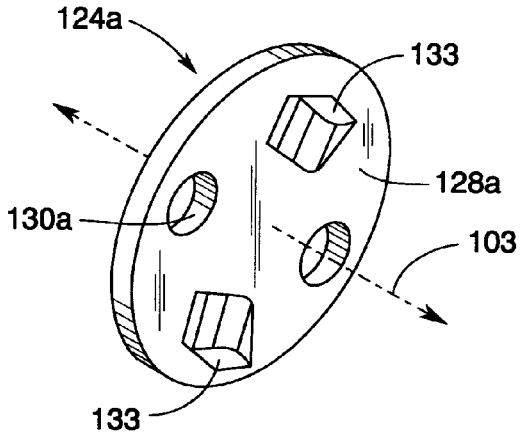
FIG. 8B is a perspective view of the piston of FIG. 8A.
Figure 8C:
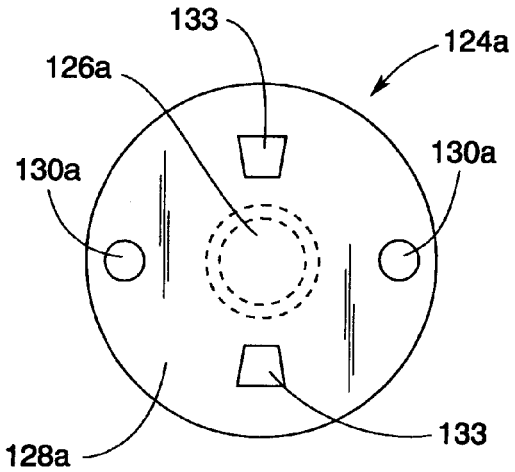
FIG. 8C is a perspective view of the piston of FIG. 8A.
Figure 8D:
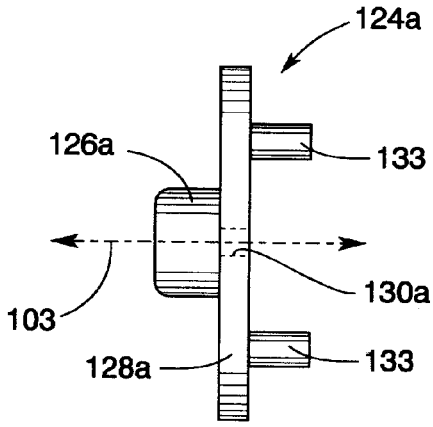
FIG. 8D is a side cross sectional view of the piston of FIG. 8A.
Figure 9A:
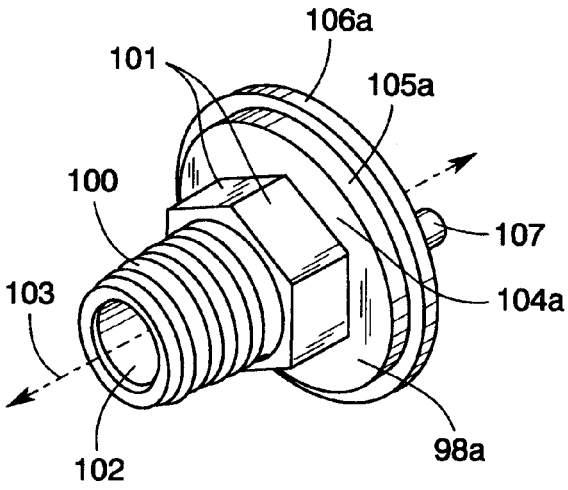
FIG. 9A is a perspective view of a body as included in the valve mechanism of FIG. 6.
Figure 9B:
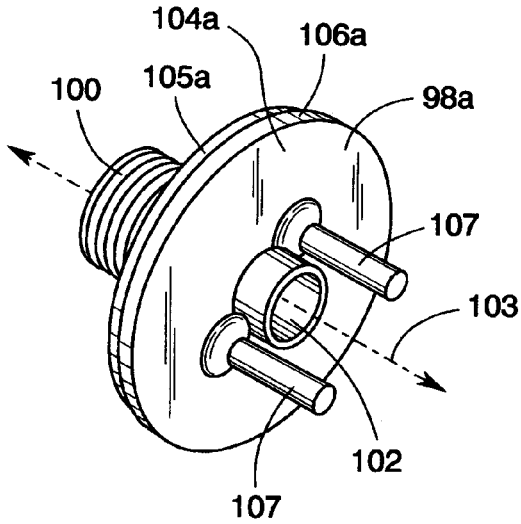
FIG. 9B is a perspective view of the body of FIG. 9A.
Figure 9C:
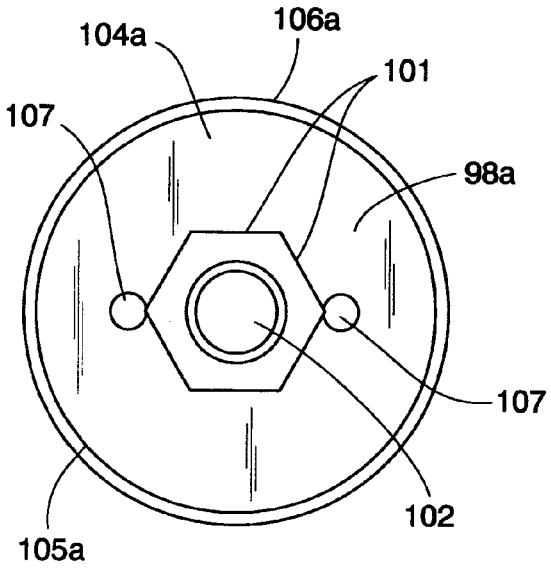
FIG. 9C is a frontal view of the body of FIG. 9A.
Figure 9D:
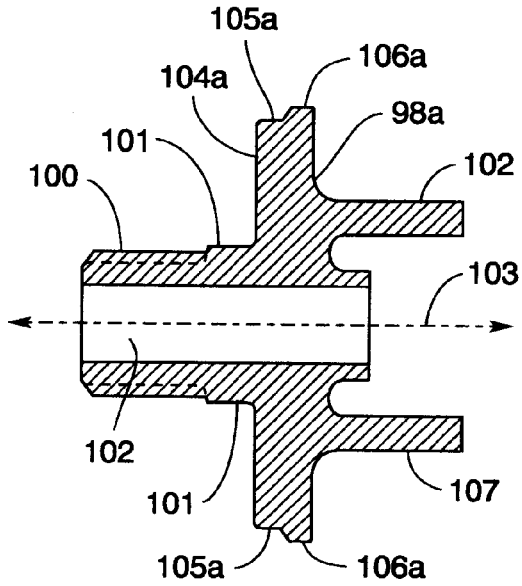
FIG. 9D is a side cross sectional view of the body of FIG. 9A.
Figure 10A:
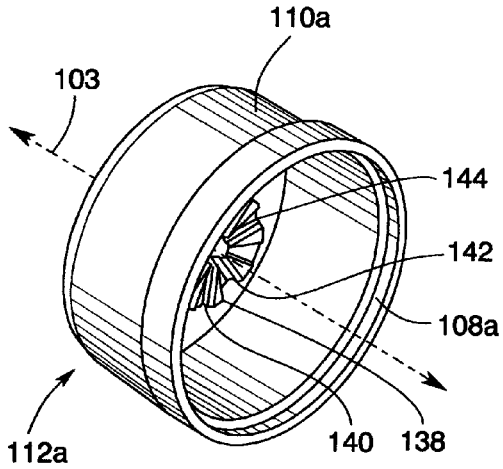
FIG. 10A is a perspective view of a cap as included in the valve mechanism of FIG. 6.
Figure 10B:
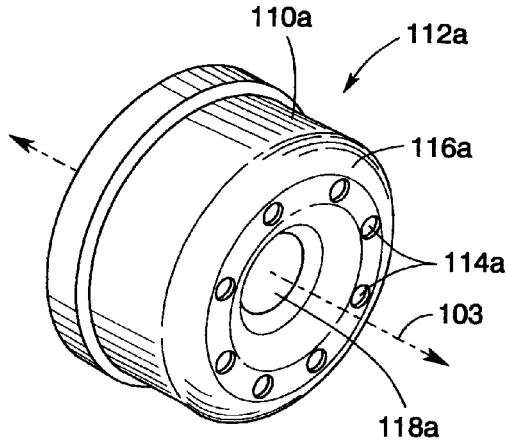
FIG. 10B is a perspective view of the cap of FIG. 10A.
Figure 10C:
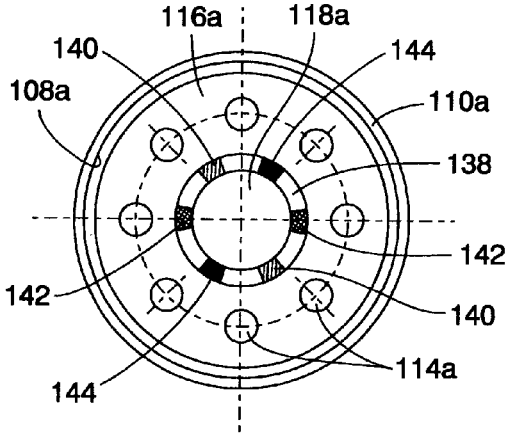
FIG. 10C is a rear view of the cap of FIG. 10A.
Figure 10D:
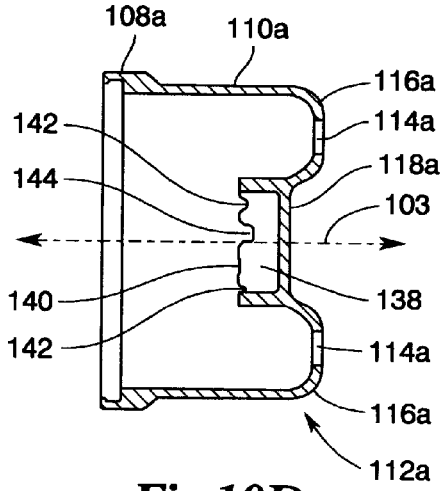
FIG. 10D is a side cross sectional view of the cap of FIG. 10A.
Figure 10E:
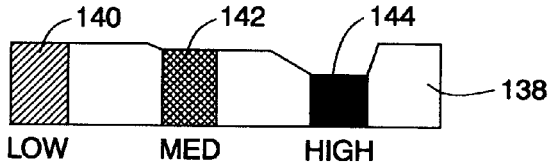
FIG. 10E is a side cross sectional view of incremental settings of the cap of FIG. 10A.

FIG. 6 depicts a manually controllable valve mechanism 68*a* having incremental positions that allow for three possible amounts of air to be drawn during each reciprocation of the piston 69. An exploded view of the manually controllable valve mechanism 68*a* of FIG. 6 is depicted in FIG. 7. The valve mechanism 68*a* is constructed around a body 98*a* that is individually depicted in the perspective views of FIGS. 9A and 9B, rear view of FIG. 9C, and cross sectional side view of FIG. 9D. The body 98*a* includes threads 100 which allow for attachment of the valve mechanism 68*a* to the inlet port 71 of the compressor unit 32. Gripping surfaces 101 allow the valve mechanism 68*a* to be tightened in place with a wrench or other installation tool.

A valve cylinder 102 extends the length of the body 98*a* to allow for the channeling of air into the inlet 70 of the compressor unit 32. As best understood with a comparison of FIGS. 6 and 7, a valve axis 103 is defined as extending down the center and along the length of the valve cylinder 102 and continues the entire length of the valve mechanism 68*a*. A spacer 104*a* extends around the valve axis 103 and outwardly from the valve cylinder 102 to a spaced edge 105*a*. The body 98*a* also includes a mounting bead 106*a* that extends the circumference of the spaced edge 105*a* and alignment legs 107 that extend from the front of the spacer 104*a*.

A cap 110*a* engages the mounting beads 106*a* with a circular mounting notch 108*a*. As best understood by comparing the perspective views of the cap 110 in FIGS. 10A and 10B with the side cross sectional view depicted in FIG. 10D, the cap 110*a* is substantially cylindrical in shape and includes a boxed (closed) end 112*a* that forms the front end of the valve mechanism 68*a*. As best understood by comparing FIGS. 10A-D with FIG. 6, the circular shape of the mounting notch 108*a* permits a full 360-degree manual rotation of the cap 110*a* about the valve axis 103 on the mounting bead 106*a*. As depicted in FIGS. 6-11D, this embodiment of the valve mechanism 68*a* permits manual rotation of the cap 110*a* to be effected by hand, though it will be appreciated that in some embodiments, such manual rotation can be effected by other remote or mechanical means.

Referring again to FIGS. 6 and 10A-D, the boxed end 112*a* of the cap 110*a* is divided into a tapered outer portion 116*a* and a center portion 118*a*. A plurality of intake holes 114*a* extend through the boxed end 112*a* of the cap 110*a* to allow air from the environment to enter into the valve mechanism 68*a*. A circular filter element 120*a* is positioned adjacent the intake holes 114*a* to remove impurities as the air passes through the intake holes 114*a* to a valve chamber 122*a* that is formed from the space between the cap 110*a* and body 98*a*. A positioning notch ring 138 is positioned at the center portion 118*a* of the boxed end 112*a* to rotate with the cap 110*a*.

The valve chamber 122*a* provides clearance to allow for the reciprocation of a valve piston 124*a*. As best understood with a comparison of FIGS. 6 and 7 with the individual perspective views of FIGS. 8A and 8B, rear view of 8C, and side cross sectional view 8D of the valve piston 124*a*, the valve piston 124*a* includes a piston head 126*a* that is aligned to reciprocate along a segment of the valve axis 103. A piston flange 128*a* extends along the circumference and near the front of the piston head 126*a*. Alignment holes 130*a* are positioned at locations on the piston flange 128*a* to allow for engagement with alignment legs 107 of the body 98*a*. The alignment legs 107 enable the piston head 126*a* to maintain alignment and a consistent amount of piston clearance 136*a* from the valve cylinder 102 at each particular position along the valve axis 103 to which the valve piston 124*a* moves. A pair of increment pins 133 extend forward from the valve piston 124*a* toward the cap 110*a*.

Referring now to FIGS. 6 and 10A-E, a piston spring 132*a* extends between the spacer 104*a* of the body 98*a* and the piston flange 128*a* to bias the piston head 126*a* away from valve cylinder 102. A retaining ring 134 secures the forward end of each alignment leg 107 to prevent the valve piston 124*a* from being ejected by the piston spring 132*a* when the cap 110*a* is removed from the body 98*a*. When the cap 110*a* is attached to body, the increment pins 133 of the valve piston 124*a* engage the positioning notch ring 138 under the compression of the piston spring 132*a*.

The notch ring 138 includes six positioning notches arranged at locations around the notch ring 138. The six notches enable the notch ring to establish three different incremental positions for the valve mechanism 68*a*. Among the six positioning notches, two low notches 140, that each extend the least distance from the valve cylinder 102, relate to a LOW setting in which a minimal amount of clearance 136*a* is maintained between the piston head 126*a* and valve cylinder 102. Two medium notches 142, that each extend an intermediate distance from the valve cylinder 102, relate to a MEDIUM setting in which an intermediate amount of clearance 136*a* is maintained between the piston head 126*a* and valve cylinder 102. Two high notches 144, that each extend the greatest distance from the valve cylinder 102, relate to a HIGH setting in which a relatively large amount of clearance 136*a* is maintained between the piston head 126*a* and valve cylinder 102. Each low, medium, or high notch 140, 142, or 144 is located at a position along the notch ring 138 that is directly opposite from the position of the second low, medium, or high notch 140, 142, or 144. This relative positioning allows the increment pins 133 to simultaneously engage each corresponding pair of notches 140, 142, or 144 and compress the valve piston 124*a* against the piston spring 132*a* according to the desired valve setting.

Consider option-1 of FIG. 1, in which the compressor unit 32 is to be operated to draw 8.8 Amps of electric current from the electrical circuit to generate 3 SCFM. As indicated, this setting can be achieved using a LOW setting of the compressor unit 32.

Accordingly, referring once again to FIG. 16, the cap 110*a* of the valve 68*a* is rotated about the valve axis 103 on the mounting bead 105*a* so that the notch ring 138 rotates with respect to the increment pins 133. The increment pins 133 and valve piston 124*a* do not rotate with the notch ring 138 under the compression of the piston spring 132*a* since they are locked in an angular position by the alignment legs 107 which extend through the alignment holes 130*a* in piston flange 128*a*. However, the piston spring 132*a* does force the valve piston 124*a* to make quick reciprocations along the valve axis 103 as the increment pins 133 quickly disengage and then re-engage each notch 140, 142, or 144. As the cap 110*a* is rotated, these quick reciprocations of the valve piston 124*a* can be perceived as audible clicks.

Figure 11C:
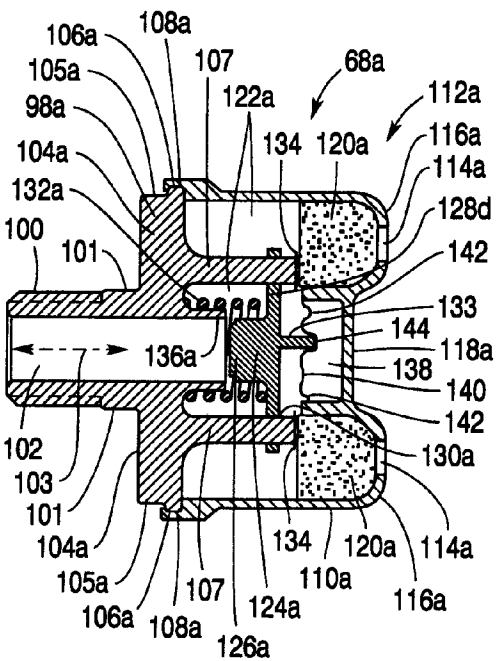
FIG. 11C is a side cross sectional view of the valve mechanism of FIG. 6 set to a HIGH position.
Figure 11B:
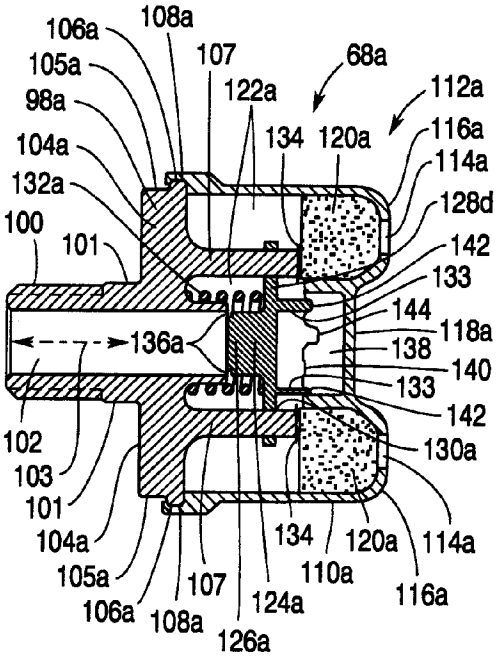
FIG. 11B is a side cross sectional view of the valve mechanism of FIG. 6 set to a MEDIUM position.
Figure 11A:
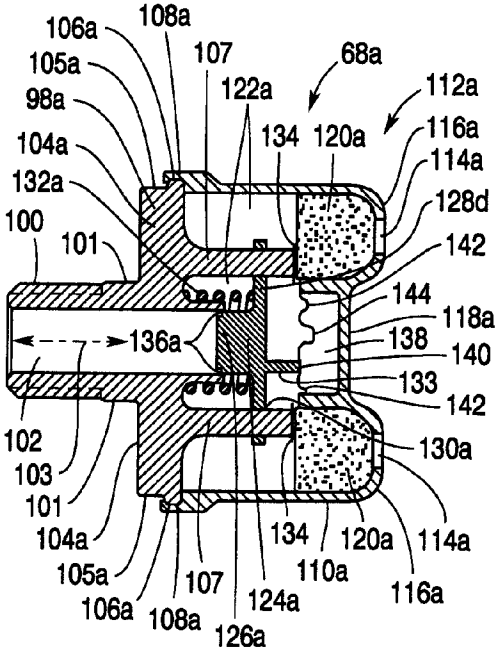
FIG. 11A is a side cross sectional view of the valve mechanism of FIG. 6 set to a LOW position.

To set the compressor unit 32 to the LOW setting, the cap 110*a* is rotated until the increment pins 133 engage the low notches 140, as depicted in FIG. 11A. Since each low notch 140 extends the least distance from the valve cylinder 102, each increment pin 133 also extends the least distance from the valve cylinder 102 under the compression of the piston spring 132*a*, causing a minimal amount of clearance 136*a* to exist between the piston head 126*a* and valve cylinder 102. However, this minimal amount of clearance 136*a* is sufficient to permit an amount of air to flow from the environment into the compression cylinder 74 of the compressor unit 32 to enable the compressor to produce 3 SCFM while drawing 8.8 Amps of electric current from the electrical circuit.

Now consider option-2 of FIG. 1, in which the compressor unit 32 is to be operated to draw 10.8 Amps of electric current from the electrical circuit to generate 5 SCFM. As indicated, this setting can be achieved using a MEDIUM setting of the compressor unit 32. To set the compressor unit 32 to the MEDIUM setting, the cap 110*a* is rotated until the increment pins 133 engage the medium notches 142, as depicted in FIG. 11B. Since each medium notch 140 extends an intermediate distance from the valve cylinder 102, each increment pin 133 also extends an intermediate distance from the valve cylinder 102 under the compression of the piston spring 132*a*, causing an intermediate amount of clearance 136*a* to exist between the piston head 126*a* and valve cylinder 102. This intermediate amount of clearance 136*a* is sufficient to permit a volume of air to flow from the environment into the compression cylinder 74 of the compressor unit 32 to enable the compressor to produce 5 SCFM while drawing 10.8 Amps of electric current from the electrical circuit.

Now consider option-3 of FIG. 1, in which the compressor unit 32 is to be operated to draw 14.0 Amps of electric current from the electrical circuit to generate 6.1 SCFM. As indicated, this setting can be achieved using a HIGH setting of the compressor unit 32. To set the compressor unit 32 to the HIGH setting, the cap 110*a* is rotated until the increment pins 133 engage the high notches 144, as depicted in FIG. 11C. Since each high notch 140 extends a relatively large distance from the valve cylinder 102, each increment pin 133 also extends a relatively large distance from the valve cylinder 102 under the compression of the piston spring 132*a*, causing a relatively large amount of clearance 136*a* to exist between the piston head 126*a* and valve cylinder 102. This large amount of clearance 136*a* is sufficient to permit an amount of air to flow from the environment into the compression cylinder 74 of the compressor unit 32 to enable the compressor unit to produce 6.1 SCFM while drawing 14.0 Amps of electric current from the electrical circuit.

Thus, by turning the cap 110*a* to the LOW, MEDIUM or HIGH settings, the valve 68*a* is manually adjusted to increase or decrease the amount of air available to be compressed with each compression stroke of a piston of the compressor in FIG. 32. This increases or decreases, respectively, the amount of electric current that is used by an electric motor, such as motor 58 shown in FIG. 2, which causes the compressors piston to reciprocate.

Figure 12C:
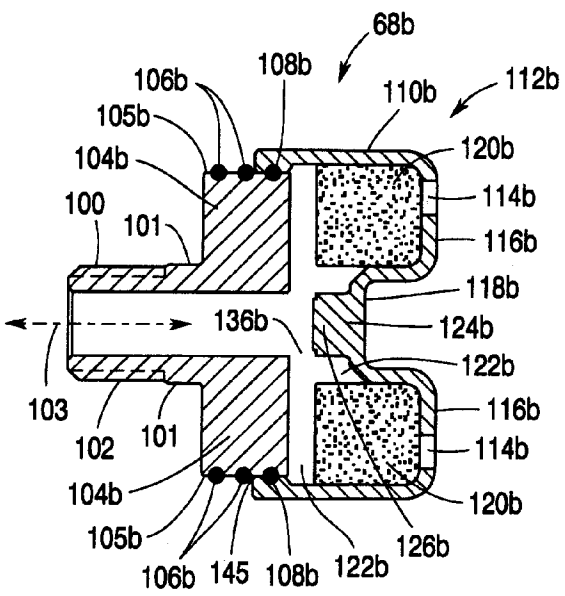
FIG. 12C is a cross sectional side view of the valve mechanism of FIG. 12A set to a HIGH position.
Figure 12B:
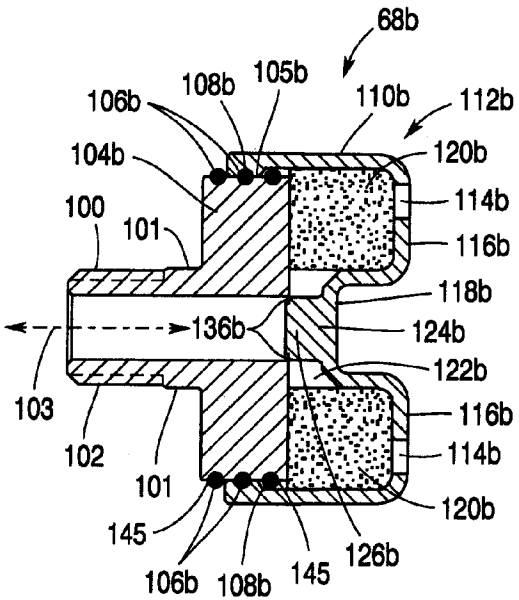
FIG. 12B is a cross sectional side view of the valve mechanism of FIG. 12A set to a MEDIUM position.
Figure 12A:
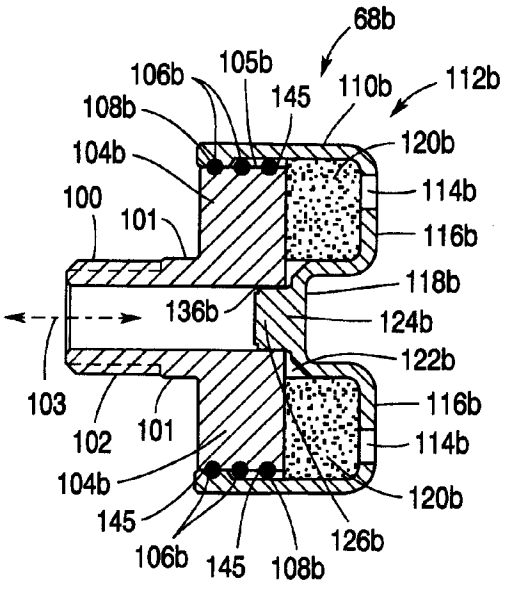
FIG. 12A is a cross sectional side view of a manually controllable valve mechanism according to one embodiment of the invention set to a LOW position.

It will be appreciated that many valve configurations can allow a manual, incremental adjustment of valve positions. FIGS. 12A-C depict an embodiment of valve 68*b* in which a spaced edge 105*b* of a spacer 104*b* includes multiple mounting beads 106*b*. In this depicted embodiment, each mounting bead 106*b* comprises a resilient ring that is flexed to fit into bead notches 145 that are positioned around the spaced edge 105*b*. The cap 110*b* of the valve 68*b* is resilient and allows for a mounting notch 108*b* within the cap 110*b* to momentarily expand and slip over each mounting bead 106*b* when the cap 110*b* is grasped by hand and pushed toward or pulled away from the inlet of the compressor unit 32. At a boxed end 112*b* of the cap 110*b*, an outer portion 116*b* includes intake holes 114*b* and a filter element 120*b*. A center portion 118*b* of the cap 110*b* has a valve piston 124*b* that is integral to the assembly of the cap 110*b*.

As the valve 68*b* is adjusted by pushing or pulling the cap 110*b* over the mounting beads 106*b*, a valve chamber 122*b* is either enlarged or reduced in size as a piston head 126*b* is either pulled further from or pushed closer toward the valve cylinder 102. This movement of the cap 110*b*, including the piston head 126*b*, will cause either an increase in the size of the piston clearance 136*b*, from a small clearance in FIG. 12A to a medium clearance in FIG. 12B, to a large clearance in FIG. 12C, or a decrease in the size of the clearance 136*b* by reversing this sequence of movement from FIG. 12C to FIG. 12A. Thus, using FIG. 3 by way of example and substituting the valve 68*b* in place of valve 68, the valve 68*b* enables a manual adjustment to be made in the amount of air that is permitted to enter the compressor unit 32*a* during each reciprocation of the piston 69 in the compression cylinder 74.

Figure 14C:
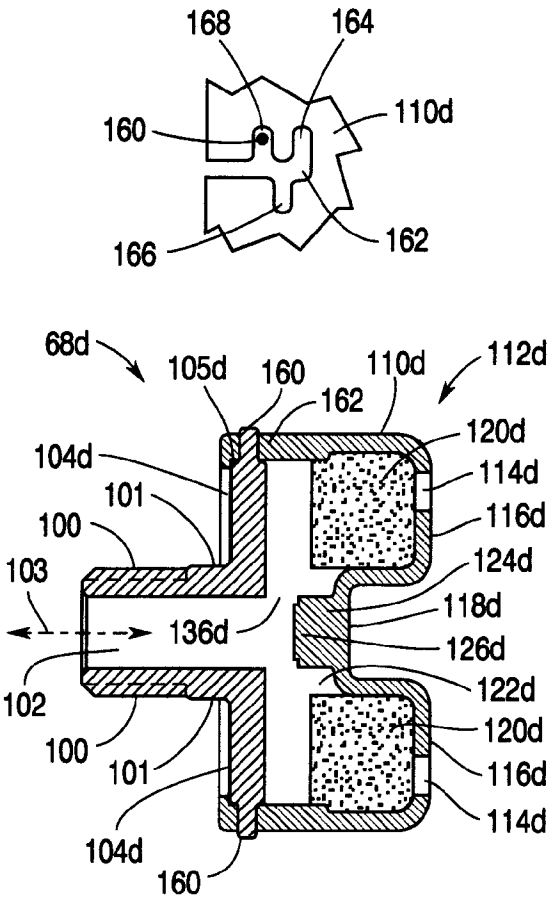
FIG. 14C is a cross sectional side view and partial outside view of the valve mechanism of FIG. 14A set to a HIGH position.
Figure 14B:
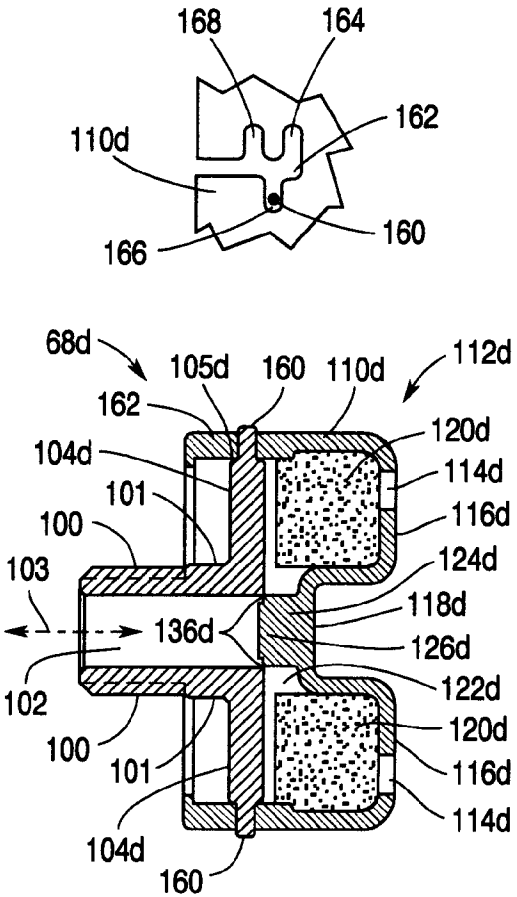
FIG. 14B is a cross sectional side view and partial outside view of the valve mechanism of FIG. 14A set to a MEDIUM position.
Figure 14A:
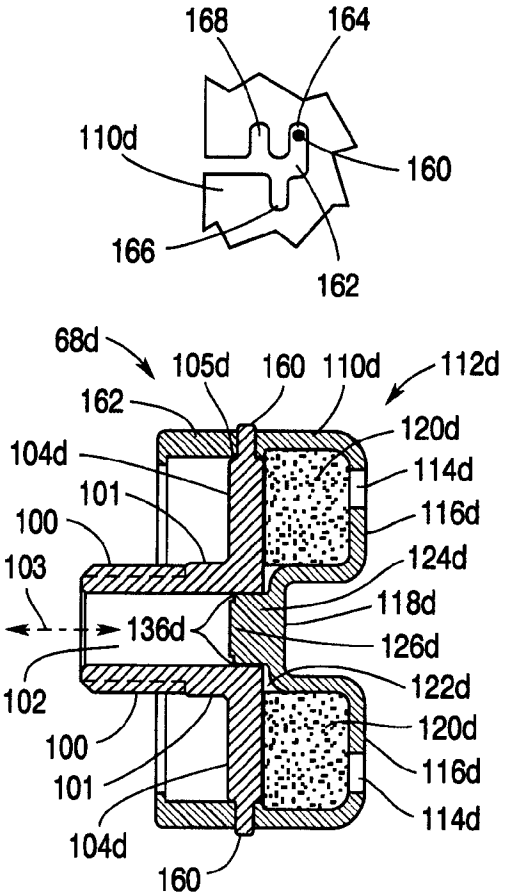
FIG. 14A is a cross sectional side view and partial outside view of a manually controllable valve mechanism according to one embodiment of the invention set to a LOW position.

It will be appreciated that while resilient rings are incorporated into the embodiment depicted in FIGS. 12A-C, the mounting beads 106*b* can also be directly molded into the spaced edge 105*b*. Other types of incremental spacing assemblies can also be used. For example, FIGS. 14A-C depict a similar manually controllable valve mechanism 68*d* having adjustment pins 160 extending from spaced edges 105*d* through variable adjustment slots 162 located at positions in the cap 110*d*. Each of FIGS. 14A-C includes a partial outside view of an adjustment slot 162. Each variable adjustment slot 162 includes a low adjustment position 164, medium adjustment position 166, and high adjustment position 168.

Consider a comparison between the side cross sectional views and partial outside views of FIGS. 14A and B. FIG. 14A depicts the valve mechanism 68*d* in a LOW compressor setting valve position with adjustment pins 160 located at the low adjustment positions 164 of each adjustment slot 162. This position requires the cap 110*d* to force the piston head 126*d* into the valve cylinder 102 to leave a minimal clearance 136*d* between the valve piston 124*d* and valve cylinder 102. The cap 110*d* can be slightly hand rotated clockwise, pulled forward, and again slightly rotated clockwise to move the adjustment pins 160 to the medium adjustment positions 166 and establish a MEDIUM compressor setting valve position as depicted in FIG. 14B. This adjustment allows for an intermediate clearance 136*d* between the valve piston 124*d* and valve cylinder 102. The cap 110*d* can then be slightly hand rotated counterclockwise, again pulled forward, and again slightly rotated counterclockwise to move the adjustment pins 160 to the high adjustment positions 168 and establish a HIGH compressor setting valve position as depicted in FIG. 14C. This adjustment allows for a relatively large clearance 136*d* between the valve piston 124*d* and valve cylinder 102.

Figure 13C:
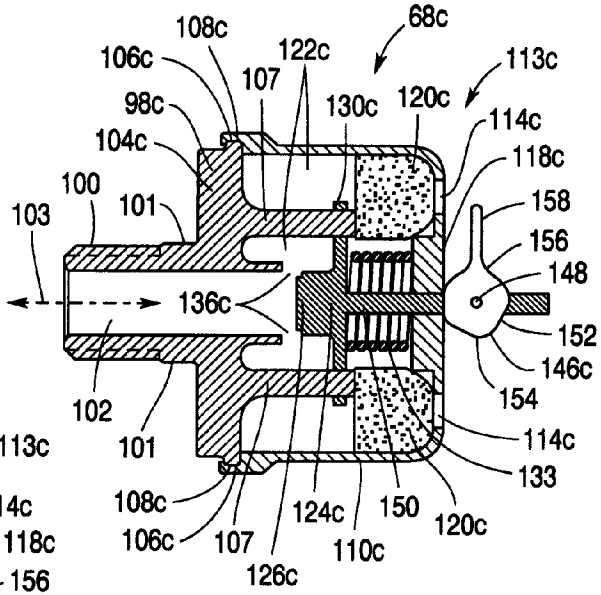
FIG. 13C is a cross sectional side view of the valve mechanism of FIG. 13A set to a HIGH position.
Figure 13B:
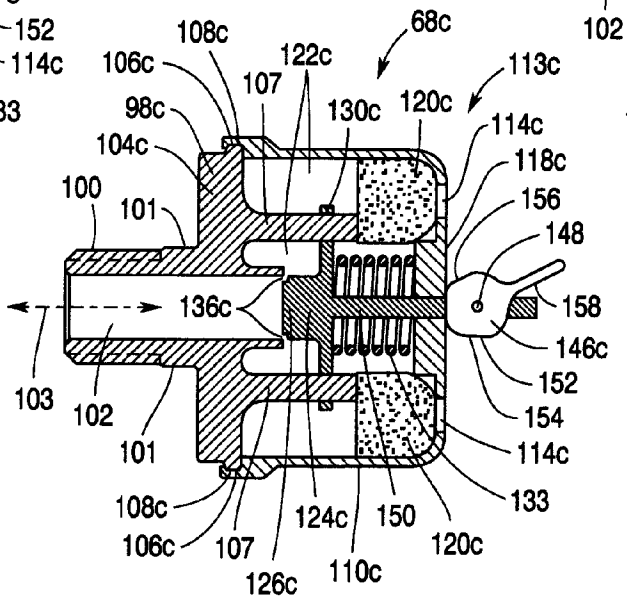
FIG. 13B is a cross sectional side view of the valve mechanism of FIG. 13A set to a MEDIUM position.
Figure 13A:
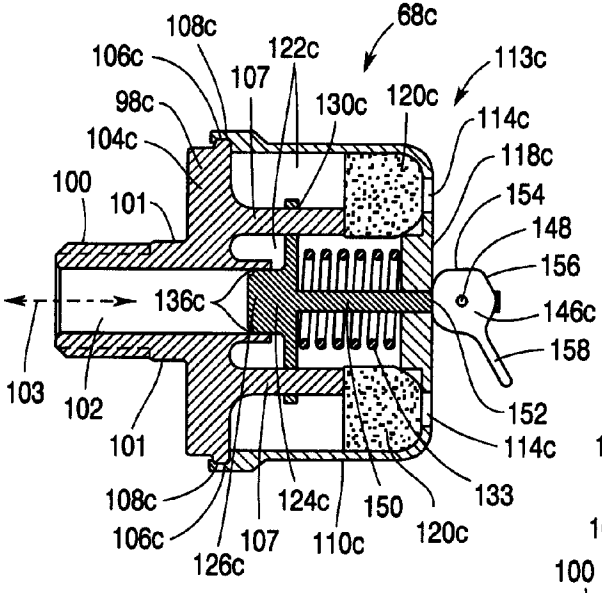
FIG. 13A is a cross sectional side view of a manually controllable valve mechanism according to one embodiment of the invention set to a LOW position.

FIGS. 13A-C depict another manually controllable valve mechanism 68*c* having an adjustment cam 146 positioned on a cam pivot 148 that is located at a center portion 118*c* of a boxed end 113*c* of a cap 110*c*. The pivot 148 is connected to a piston extension 150 that extends from a valve piston 124*c* through the center portion 118*c* of the cap 110*c*. A piston spring 132*c* biases the valve piston 124*c* toward the valve cylinder 102.

An adjustment cam 146*c* includes a low cam surface 152, medium cam surface 154, and high cam surface 156 which allow for LOW, MEDIUM, and HIGH compressor settings, respectively. The valve 68*c* is depicted in a LOW compressor setting in FIG. 13A. The low cam surface 152 of the cam 146*c* locks against the center portion 118*c* of the boxed end 113*c* of the cap 110*c*. The cam 146*c* is constructed so that the low cam surface 152 is separated from the pivot 148 by a distance that is smaller than the distances separating the pivot 148 from the medium cam surface 154 and the high cam surface 156. The cap 110*c* is held in constant position with respect to a body 98*c* by a mounting notch 108*c* that locks to a mounting bead 106*c* of the body 98*c*. The valve piston 124*c* is able to reciprocate within the valve chamber 122*c* on alignment legs 107. By locking against the center portion 118*c* of the cap 110*c*, the cam restricts the distance that the piston spring 122*c* can compress the valve piston 124*c* by limiting the movement of the piston extension 150 to a position where a segment of the extension 150 equal to the length between the low cam surface 152 and pivot 148, remains outside the cap 110*c*.

Due to the smaller distance between the low cam surface 152 and pivot 148, the LOW compressor setting, as depicted in FIG. 13A, allows the piston spring 132*c* to press the valve piston 124*c* sufficiently to force the piston head 126*c* to enter the valve cylinder 102, leading to a minimal clearance 136*c* between the valve piston 124*c* and valve cylinder 102. This allows a minimal amount of air to be drawn through the intake holes 114*c* and filter element 120*c* and pass into the valve cylinder 102 and compressor unit 32.

Referring now to FIG. 13B, the valve mechanism 68*c* can be manually adjusted to a MEDIUM compressor setting by rotating the cam 146 counterclockwise by hand with the cam lever 158 to allow the low cam surface 152 to unlock against the center portion 118*c* of the boxed end 113*c* of the cap 110*c* and to cause the medium cam surface 154 to lock against the center portion 118*c*. The medium cam surface 154 is separated from the pivot 148 by a distance that is larger than the distance separating the low cam surface 152 from the pivot 148 but smaller than the distance separating the pivot 148 from the high cam surface 156. Due to the larger distance between the medium cam surface 154 and pivot 148, the MEDIUM compressor setting, as depicted in FIG. 13B, allows the piston spring 132*c* to partially withdraw the piston head 126*c* from the valve cylinder 102, leading to an intermediate amount of clearance 136*c* between the valve piston 124*c* and valve cylinder 102. This allows an intermediate amount of air to be drawn through the intake holes 114*c* and filter element 120*c* and pass into the valve cylinder 102 and compressor unit 32.

Referring now to FIG. 13C, the valve mechanism 68*c* can be manually adjusted to a HIGH compressor setting by rotating the cam 146 counterclockwise by hand with the cam lever 158 to allow the medium cam surface 154 to unlock against the center portion 118*c* of the boxed end 113*c* of the cap 110*c* and to cause the high cam surface 156 to lock against the center portion 118*c*. The high cam surface 156 is separated from the pivot 148 by a distance that is larger than the distances separating both the low cam surface 152 and medium cam surface 164 from the pivot 148. Due to the larger distance between the high cam surface 156 and pivot 148, the HIGH compressor setting, as depicted in FIG. 13C, allows the piston spring 132*c* to fully withdraw the piston head 126*c* from the valve cylinder 102, leading to a relatively large amount of clearance 136*c* between the valve piston 124*c* and valve cylinder 102. This allows a relatively large amount of air to be drawn through the intake holes 114*c* and filter element 120*c* and pass into the valve cylinder 102 and compressor unit 32.

Figure 15A:
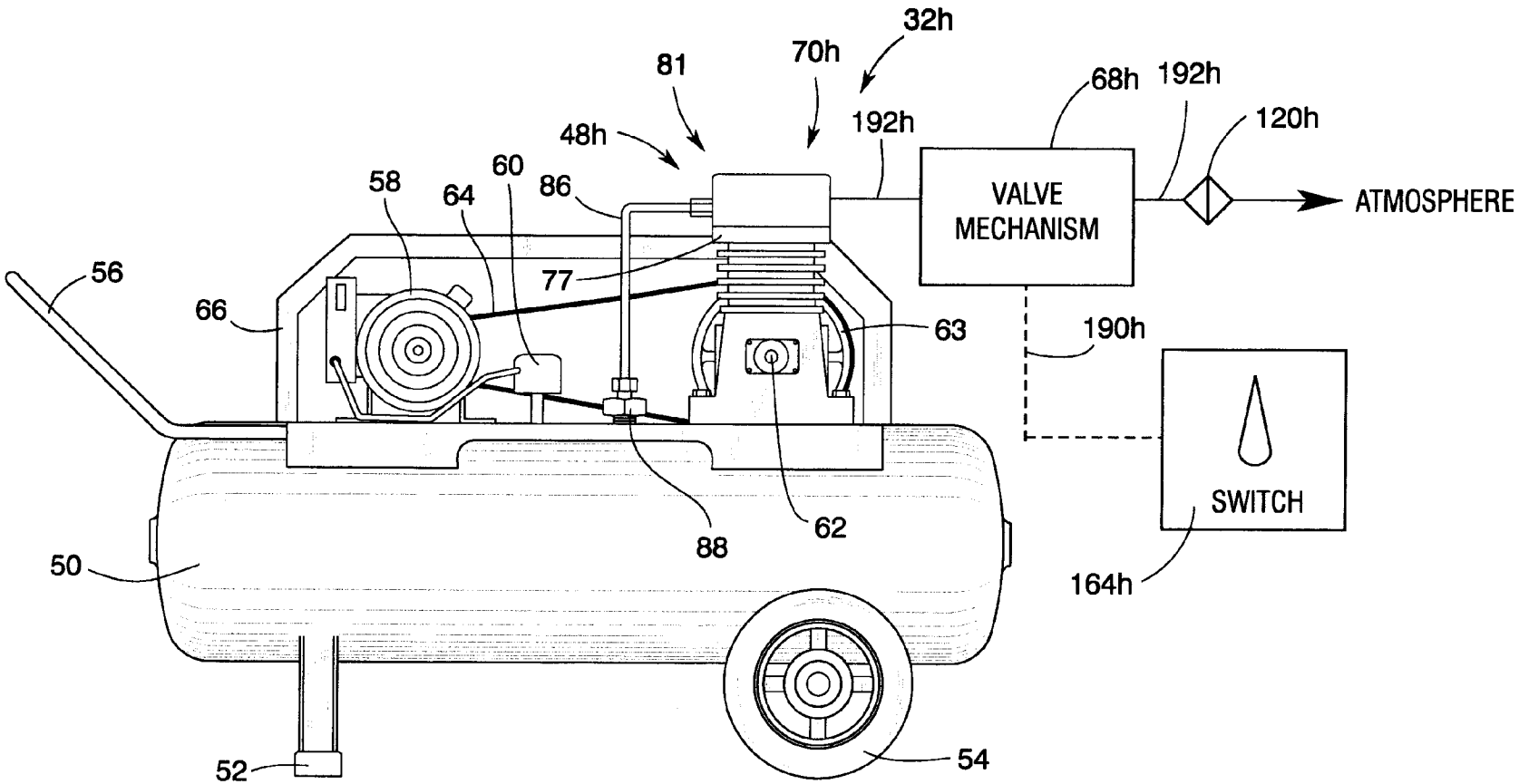
FIG. 15A depicts a manually controllable electric motor driven reciprocating air compressor unit according to one embodiment of the invention.

Although the invention has been shown and described as incorporating valves that can be manually adjusted by hand, it will be appreciated that the invention can also be appropriately implemented with valves that are manually adjustable from remote locations or manually adjustable with the assistance of mechanically or electronically actuated mechanisms. FIG. 15A depicts a compressor unit 32*h* having an air flow control valve mechanism 68*h* that is operated from a spatially separated or remote location with a is selector switch 164*h* connected to the valve mechanism 68*h* with a logic line 190*h*. The valve mechanism 68*h* is located along an inlet path 192*h* between a filter element 120*h* and the inlet 70*h* of the compressor pump 48*h*. The valve mechanism 68*h* can be configured for adjustment incrementally, that is, step-by-step or non-incrementally on a continuous basis using electrical, pneumatic, or other like actuation. Accordingly, the selector switch 164*h* can be configured to allow for either stepped settings or continuously varying settings and to communicate those settings by sending an electric, pneumatic, hydraulic or mechanical signal to the valve mechanism 68*h* through the logic line 190*h*. A wireless or other type of remote signal is also possible in lieu of the logic line 190.

Figure 15B:
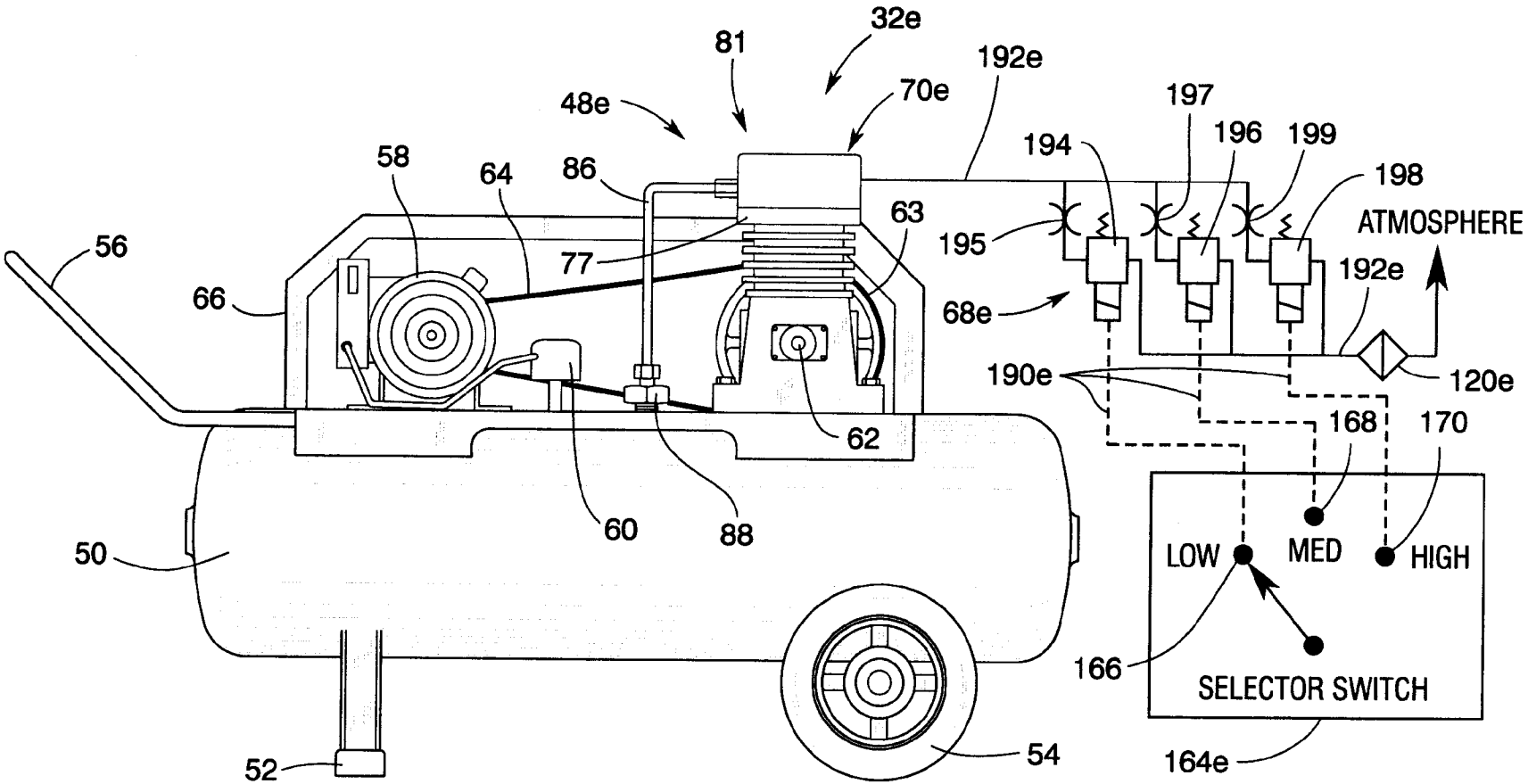
FIG. 15B depicts a manually controllable electric motor driven reciprocating air compressor unit having an electrically operated manual control according to one embodiment of the invention.

It will be further appreciated that the valve mechanism 68 can be configured to comprise multiple separate valve units. FIG. 15B depicts a compressor unit 32*e* having an incrementally adjustable valve mechanism 68*e* that is one possible variation of the compressor unit 32*h* depicted in FIG. 15A. In FIG. 15B, the valve mechanism 68*e* includes a low solenoid control 194 connected to a low setting valve 195, a medium solenoid control 196 connected to a medium setting valve 197, and a high solenoid control 198 connected to a high setting valve 199. Each of the low, medium, and high setting valves 195, 197, and 199 are biased to CLOSED positions and are located in parallel along the inlet path 192*e* between the filter element 120*e* and inlet 70*e* of the compressor pump 48*e*. Manual adjustment of the valve mechanism 68*e* is performed with a selector switch 164*e*.

The selector switch 164*e* includes a selectable LOW setting 166, MEDIUM setting 168, and HIGH setting 170. The LOW setting 166 of the selector switch 164*e* enables the low solenoid control 194 to assume an ON condition that mechanically actuates the low setting valve 195 to move to an OPEN position, as shown in FIG. 15B. The MEDIUM and HIGH settings 168 and 170 of the selector switch 164*e* similarly enable respective operation of the medium and high solenoid controls 196 and 198, enabling respective actuation of the medium and high setting valves 197 and 199 to OPEN positions.

The selector switch 164*e* can only enable the operation of one of the LOW, MEDIUM, or HIGH solenoid controls 194, 196, or 198 at any one time. Thus, when any one solenoid control assumes an ON condition, the remaining two controls must assume an OFF condition. This configuration prevents conflicting actuation of the low, medium, and high setting valves 195, 197, and 199 since each is biased to a CLOSED position. Thus, no more than one setting valve can assume an OPEN position at any one time, limiting the amount of air that can be drawn into the compression cylinder 74 to an amount that can be drawn through the selected setting valve during each intake stroke of the piston 69.

Figure 16C:
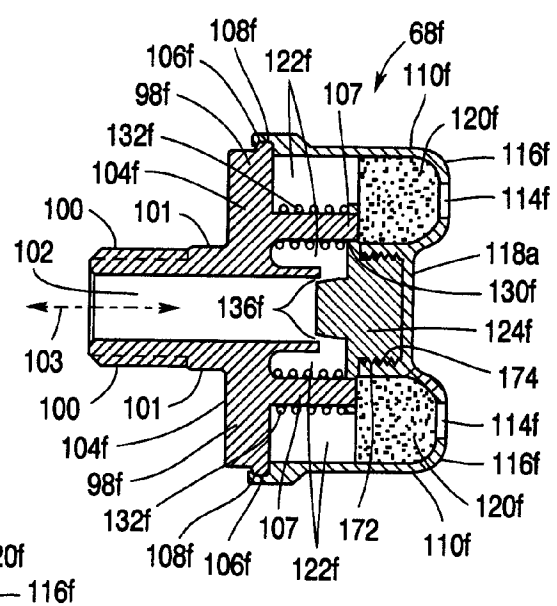
FIG. 16C is a cross sectional side view of the valve mechanism of FIG. 16A set to a position that allows for a relatively large amount of air to enter the compression cylinder of a compressor unit.
Figure 16B:
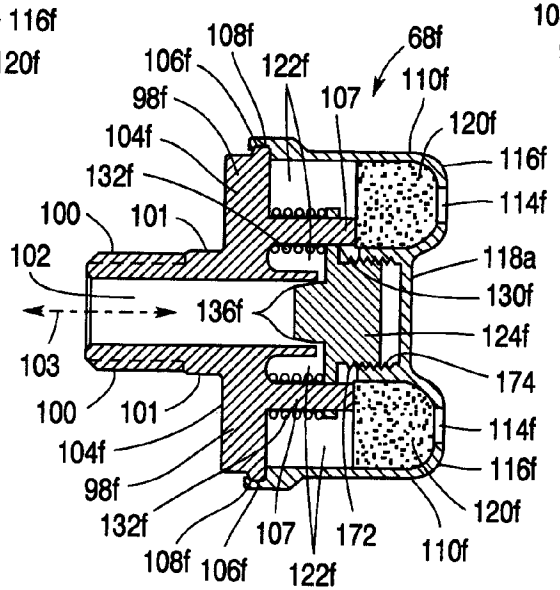
FIG. 16B is a cross sectional side view of the valve mechanism of FIG. 16A set to a position that allows for an intermediate amount of air to enter the compression cylinder of a compressor unit.
Figure 16A:
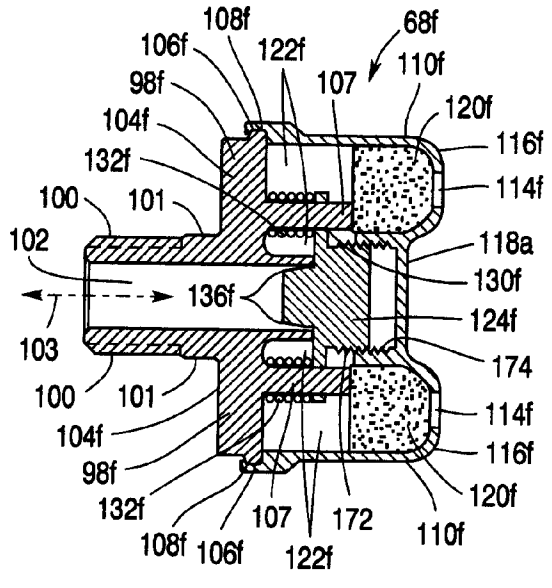
FIG. 16A is a cross sectional side view of a manually controllable valve mechanism according to one embodiment of the invention set to a position that allows for a minimal amount of air to enter the compression cylinder of a compressor unit.

It will be appreciated that the invention can be configured to allow for non-incremental valve adjustment. FIGS. 16A-C depict a valve mechanism 68*f* in which the valve piston 124*f* includes male threads 172 that are configured to engage female threads 174 located at the center portion 118*f* of the cap 110*f*. The mounting notch 108*f* of the cap 110*f* allows for free rotation of the cap 110*f* on the mounting bead 106*f* of the body 98*f* about the valve axis 103. The valve piston 124*f* is biased forward with piston springs 132*f* that are positioned around each alignment leg 107. When the cap 110*f* is hand turned about the valve axis 103, the female threads 174 cause forward or rearward movement of the valve piston 124*f*. The alignment legs 107 extend through alignment holes 130*f* thereby preventing rotation of the valve piston 124*f* itself.

This arrangement does not restrict the valve mechanism 68*f* to a specific number of incremental positions. As depicted in FIG. 16A, the valve 68*f* can be closed by rotating the cap 110*f* until the piston flanges 128*f* contact the valve cylinder 102, blocking air flow between the valve chamber 122*f* and valve cylinder 102. As best understood by comparing FIGS. 168 and 16C, the valve mechanism 68*f* can be opened to any partially open position, such as that depicted in FIG. 16B, by rotating the cap 110*f* in the opposite direction until the valve mechanism 68*f* is fully opened, as depicted in FIG. 16C, when the piston flanges 128*f* contact the center portion 118*f* of the cap 110*f*, the center portion 118*f* restricting further forward movement of the valve piston 124*f*.

Figure 17A:
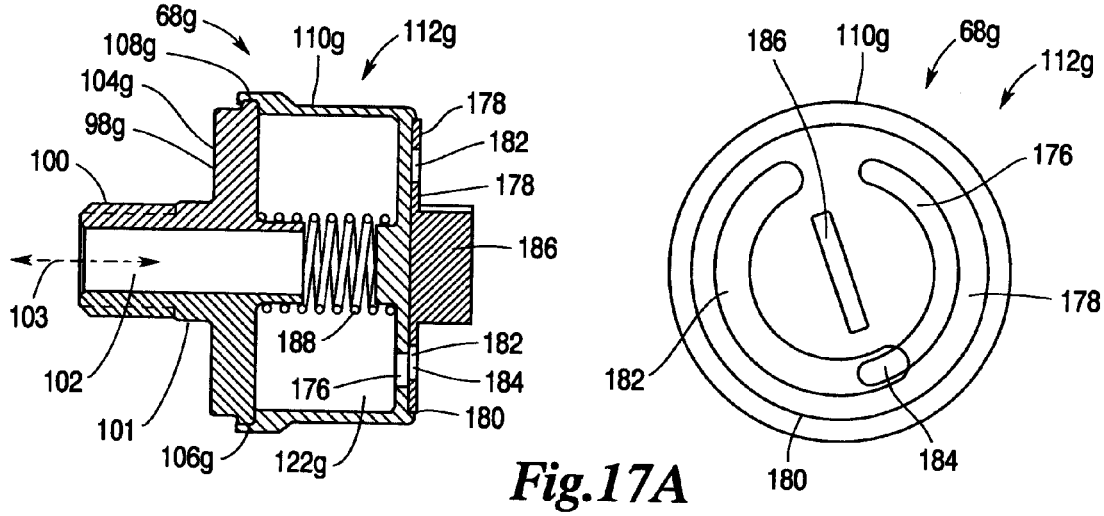
FIG. 17A is a cross sectional side view and a front view of a manually controllable valve mechanism according to one embodiment of the invention set to a position that allows for a minimal amount of air to enter the compression cylinder of a compressor unit.
Figure 17B:
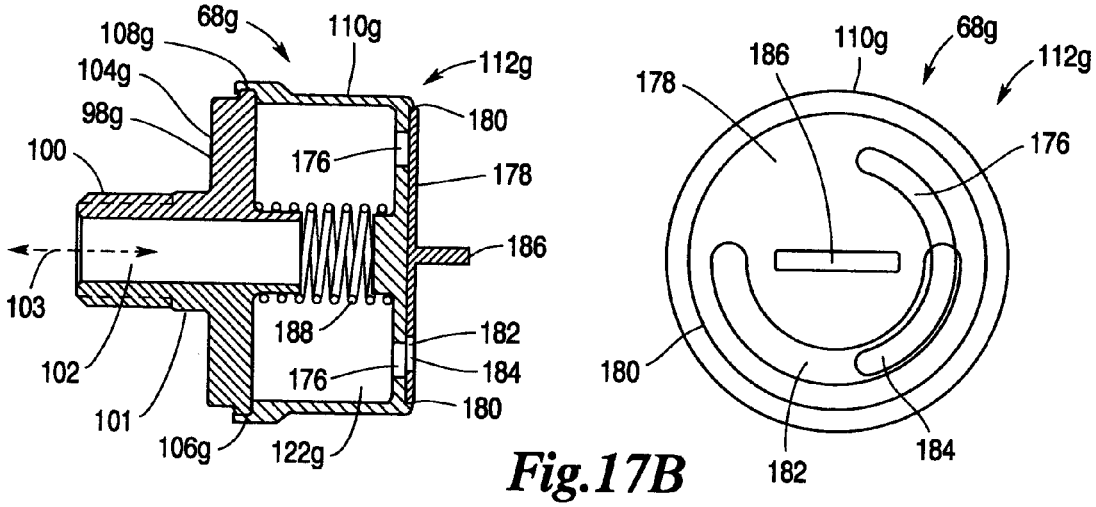
FIG. 17B is a cross sectional side view and a front view of the valve mechanism of FIG. 17A set to a position that allows for an intermediate amount of air to enter the compression cylinder of a compressor unit.
Figure 17C:
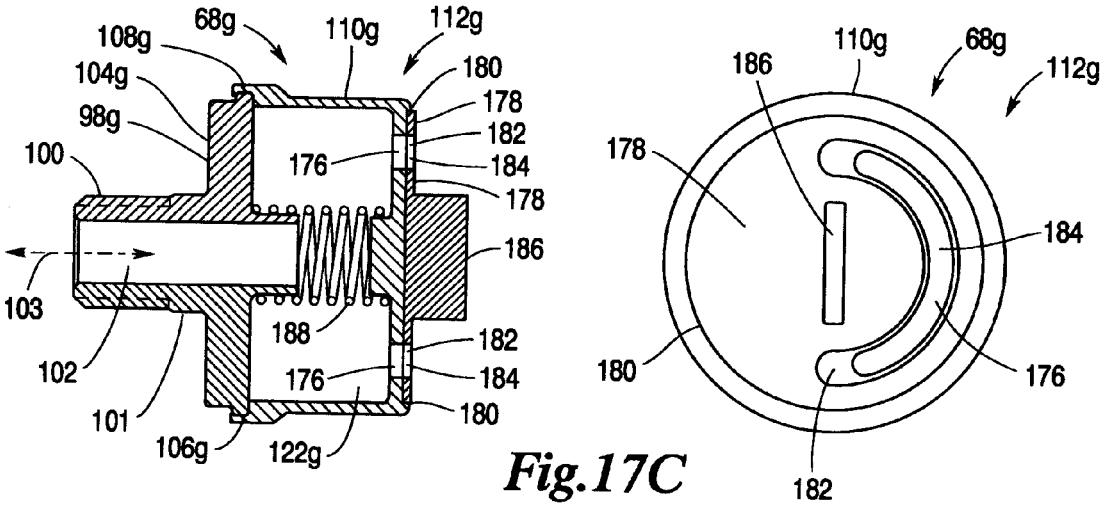
FIG. 17C is a cross sectional side view and a front view of the valve mechanism of FIG. 17A set to a position that allows for a relatively large amount of air to enter the compression cylinder of a compressor unit.

Referring now to FIGS. 17A-C, an additional embodiment valve 68*g* is depicted that allows for adjustment without the use of a piston. The cap 110*g* of the valve 68*g* includes a mounting notch 108*g* that is fixed to the mounting bead 106*g* of the valve body 98*g* to prevent rotation of the cap 110*g* about the valve axis 103. As best understood by comparing the side cross sectional side and front views of FIG. 17A, the boxed end 112*g* of the cap 110*g* has an inner notch 176 positioned to extend through an arcuate segment around the valve axis 103. A disk 178 is positioned to rotate within a disk groove 180 that is located along the circumference of the boxed end 112*g* of the cap 110*g*. The disk 178 has an outer notch 182 positioned to extend through an arcuate segment around the valve axis 103.

When the disk 178 is installed to rotate within the disk groove 180 of the cap 110*g*, the inner notch 176 of the cap 110*g* and outer notch 182 of the disk 178 can be either partially or fully aligned at an overlap 184. The size of the overlap 184 can be adjusted by hand turning a knob 186 located at the center of the disk 178 to rotate the disk 178 within the disk groove 180. The outer notch 182 rotates along with the disk 178 to allow for an adjustment in the size of the overlap 184. A support spring 188 extends from the valve cylinder 102 to the inside surface of the cap 110*g* to provide structural support for the cap 110*g* and to exert outward tension against the disk 178. After the disk 178 has been hand rotated to allow for a desired size of the overlap 184, the outward tension of the support spring 188 secures the disk 178 into position and prevents unintended disk rotation due to accidental contact, slippage or vibration.

The overlap 184 can be adjusted to terminate airflow between the environment and valve chamber 122*g* by rotating the disk 178 so that no overlap exists between the outer notch 182 and inner notch 176, or as depicted in FIG. 17A, be adjusted for only minimal airflow by allowing for a minimal amount of overlap 184 between the outer notch 182 and inner notch 176. The amount of overlap 184 between the outer notch 182 and inner notch 176 corresponds to a specific amount of air that will be drawn into the compressor unit 32 during each reciprocation of the piston 69. The amount of overlap 184, along with the amount of air that is admitted during each piston reciprocation, continues to increase as the disk 178 is further rotated about the valve axis 103, such as to the position depicted in FIG. 17B. The valve mechanism 68*g* is fully opened and admits a maximum amount of air for each piston reciprocation when the disk 178 is rotated so that the outer notch 182 completely overlaps the inner notch 176, as depicted in FIG. 17C.

Figure 18C:
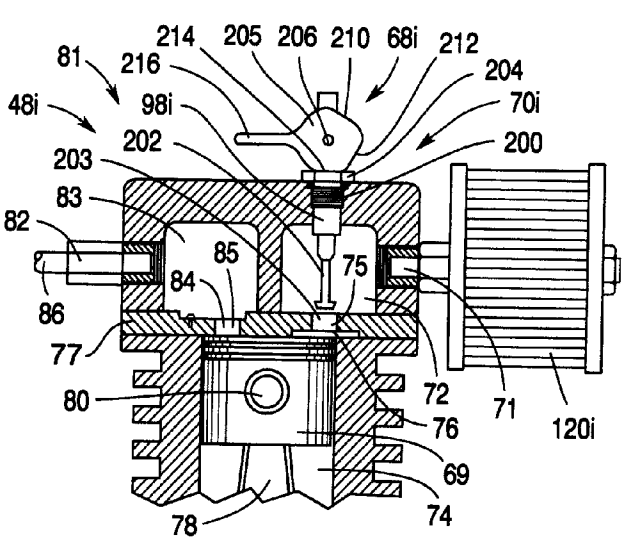
FIG. 18C is a cross sectional side view of a compressor pump according to one embodiment of the invention having a valve mechanism set to a HIGH position.
Figure 18B:
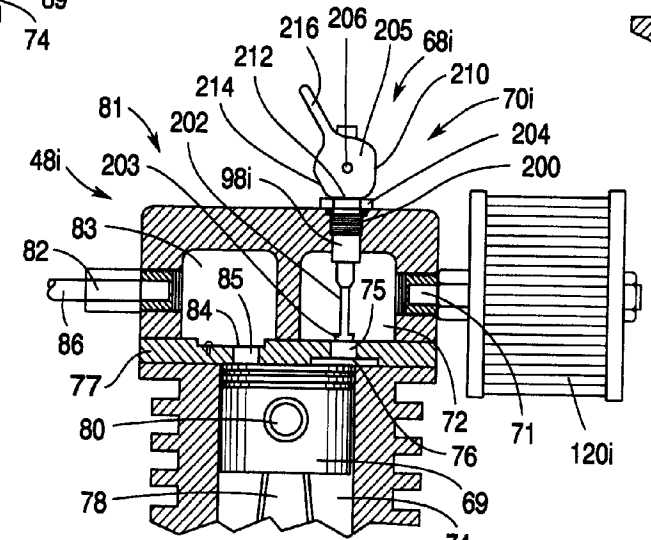
FIG. 18B is a cross sectional side view of a compressor pump according to one embodiment of the invention having a valve mechanism set to a MEDIUM position.
Figure 18A:
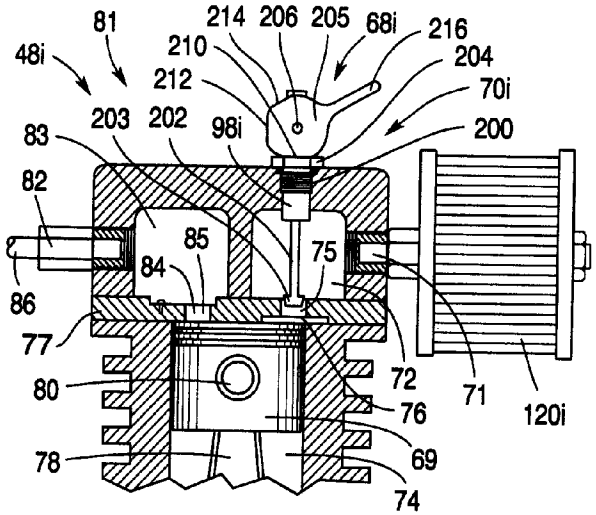
FIG. 18A is a cross sectional side view of a compressor pump according to one embodiment of the invention, having a valve mechanism set to a LOW position.

Some embodiments of the invention allow for the incorporation of a valve mechanism into the compressor pump 48 without requiring direct attachment to the inlet port 71 or integration with the filter element 120. FIGS. 18A-C depict cross sectional views of one contemplated compressor pump 48*i* having an incrementally adjustable valve mechanism 68*i* that is mounted to extend into the inlet chamber 72 without being directly connected to the inlet port 71. The valve mechanism 68*i* has a threaded body 98*i* that is inserted into a threaded mechanism aperture 200 extending into the inlet chamber 72. The body 98*i* includes a body head 204 that is grip surfaced to allow for engagement of a wrench or similar tightening tool. A valve rod 202 is positioned to reciprocate through the body 98*i* and inlet chamber 72 and to extend to the inlet hole 75. The valve rod 202 ends with a piston tip 203 that is capable of being inserted into the inlet hole 75. A spring (not shown) within the body 98*i* biases the valve rod 202 toward the inlet hole 75.

A rod cam 205 is mounted to the valve rod 202 with a rod pivot 206. The rod cam 204 includes a low cam surface 210, medium cam surface 212, and high cam surface 214 which allow the valve mechanism 68*i* to assume different positions and to achieve LOW, MEDIUM, and HIGH compressor settings, respectively.

The valve mechanism 68*i* is depicted in a LOW setting in FIG. 18A. Due to the bias of the valve rod 202, the low cam surface 210 of the rod cam 205 locks against the body head 204. The rod cam 205 is constructed so that the low cam surface 210 is separated from the rod pivot 206 by a distance that is smaller than the distances separating the rod pivot 206 from the medium cam surface 212 and high cam surface 214. By locking against the body head 204, the cam restricts the distance that the bias of the valve rod 202 forces the valve rod 202 to move toward the inlet hole 75. However, due to the smaller distance between the low cam surface 210 and rod pivot 206, the LOW setting allows the bias of the valve rod 202 to cause the piston tip 203 to enter the inlet hole 75, leading to a minimal clearance between the piston tip 203 and inlet hole 75 and allowing a minimal amount of air to be drawn into the compression cylinder 74 during each intake stroke of the piston 69.

Referring now to FIG. 18B, the valve mechanism 68*i* can be adjusted to a MEDIUM setting by rotating the rod cam 205 counterclockwise by hand with the cam lever 216 to allow the low cam surface 210 to unlock against the body head 204 and to cause the medium cam surface 212 to lock against the body head 204 due to the bias of the valve rod 202. The medium cam surface 212 is separated from the rod pivot 206 by a distance that is larger than the distance separating the low cam surface 210 from the rod pivot 206 but smaller than the distance separating the rod pivot 206 from the high cam surface 214. Due to the larger distance between the medium cam surface 212 and rod pivot 206, the MEDIUM setting, as depicted in FIG. 18B, allows the piston tip 203 to partially withdraw from the inlet hole 75, leading to an intermediate amount of clearance between the piston tip 203 and inlet hole 75 and allowing an intermediate amount of air to be drawn into the compression cylinder 74 during each intake stroke of the piston 69.

Referring now to FIG. 18C, the valve mechanism 68*i* can be adjusted to a HIGH setting by rotating the rod cam 205 counterclockwise by hand with the cam lever 216 to allow the medium cam surface 212 to unlock against the body head 204 and to cause the high cam surface 214 to lock against the body head 204 due to the bias of the valve rod 202. The high cam surface 156 is separated from the rod pivot 206 by a distance that is larger than the distances separating both the low cam surface 210 and medium cam surface 212 from the rod pivot 206. Due to the larger distance between the high cam surface 214 and rod pivot 206, the HIGH setting, as depicted in FIG. 18C, allows the piston tip 203 to fully withdraw from the inlet hole 75, leading to a relatively large amount of clearance between the piston tip 203 and inlet hole 75 and allowing a relatively large amount of air to be drawn into the compression cylinder 74 during each intake stroke of the piston 69.

Figure 19C:
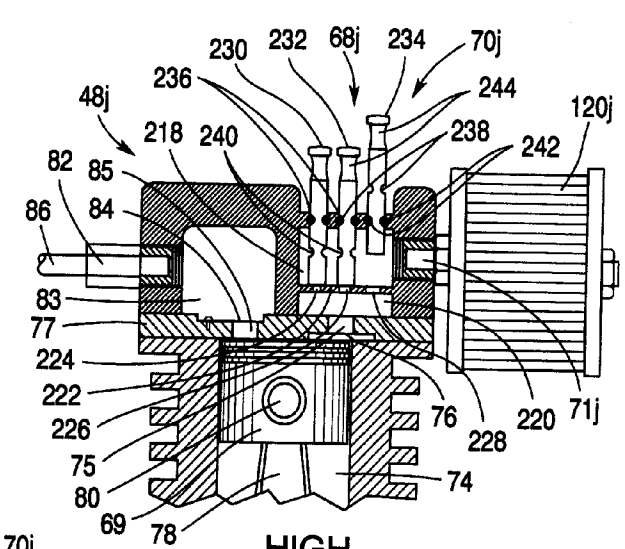
FIG. 19C is a cross sectional side view of a compressor pump according to one embodiment of the invention having a valve mechanism set to a HIGH position
Figure 19B:
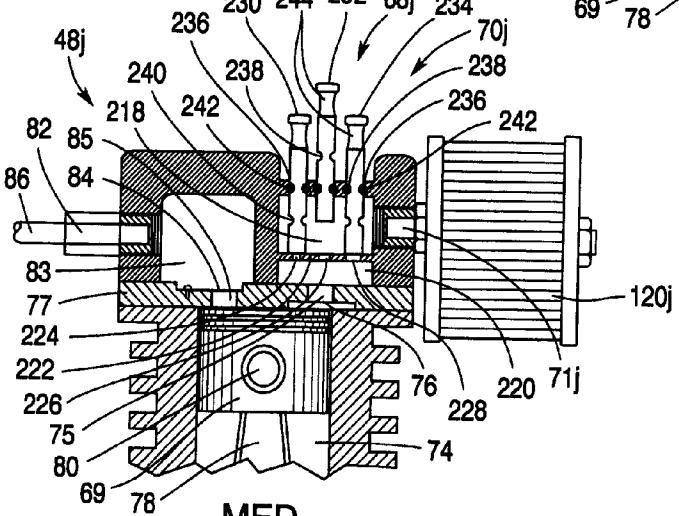
FIG. 19B is a cross sectional view of a compressor pump according to one embodiment of the invention having a valve mechanism set to a MEDIUM position.
Figure 19A:
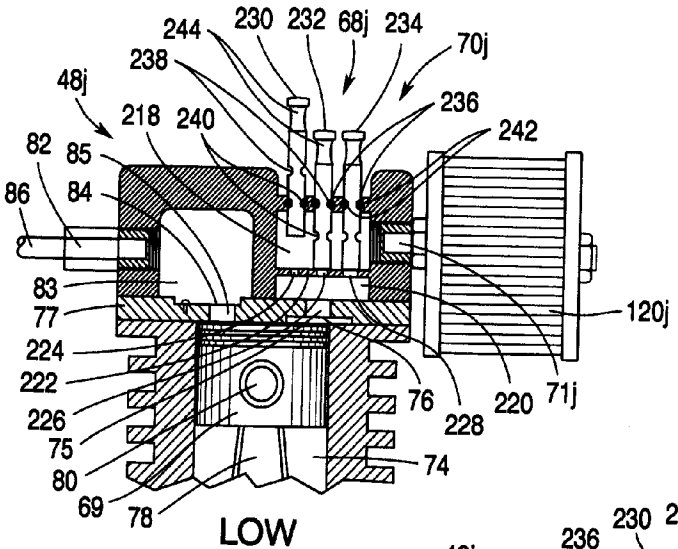
FIG. 19A is a cross sectional side view of a compressor pump according to one embodiment of the invention having a valve mechanism set to a LOW position.

FIGS. 19A-C depict an additional contemplated valve mechanism 68*j* that allows for incremental adjustment without requiring mounting to the inlet port 71*j*. The inlet chamber is divided into an upper inlet chamber 218 and lower inlet chamber 220 with a chamber partition 222. Air enters the compressor pump 48*j* from the environment through the filter element 120*j* passing through the inlet port 71*j* to the upper inlet chamber 218. The chamber partition 222 includes a low partition hole 224, medium partition hole 226, and high partition hole 228, the medium partition hole 226 being larger than the low partition hole 224 and the high partition hole 228 being larger than the medium partition hole 226.

A low valve stem 230, medium valve stem 232, and high valve stem 234 reciprocate through seal apertures 236 that extend through the inlet 70*j* into the upper inlet chamber 218. Each of the low, medium, and high valve stems 230, 232, and 234 include an upper positioning groove 238 and a lower positioning groove 240 that are positioned to engage elastic sealing rings 242 located within each seal aperture 236 and also include a handle 244 extending outside the compressor pump 48. The valve stems are configured to contact the chamber partition 222 and obstruct the passage of air through one of the low, medium, or high partition holes 224, 226, or 228 when an upper positioning groove 238 engages the sealing ring 242 within a seal aperture 236. The valve stems are further configured to not contact the chamber partition 222 and allow the passage of air through one of the low, medium, or high partition holes 224, 226, or 228 when a lower positioning groove 240 engages the sealing ring 242 within a seal aperture 236.

FIG. 19A depicts the valve mechanism 68*j* set to a LOW compressor setting. The lower positioning groove 240 of the low valve stem 230 engages the sealing ring 242 of one seal aperture 236. This allows for a clearance between the low valve stem 230 and chamber partition 222, allowing air to flow through the low partition hole 224. The upper positioning grooves 238 of the medium valve stem 232 and high valve stem 234 also engage sealing rings 242 of the two remaining seal apertures 236, allowing the medium valve stem 232 and high valve stem 234 to restrict air from flowing through the medium partition hole 226 and high partition hole 228. Due to the small size of the low partition hole 224, an amount of air passes from the upper inlet chamber 218 through the low partition hole 224 to the lower inlet chamber 220 for each intake stroke of the piston 69 that is less than the amounts that can pass when the valve mechanism 68*j* set to the MEDIUM or HIGH compressor settings.

FIG. 19B depicts the valve mechanism 68*j* set to a MEDIUM compressor setting. The low valve stem 230 is pushed downward by hand with the handle 244 so that the seal ring 242 of the low valve stem 230 expands to disengage the lower positioning groove 240 of the low valve stem 230. The sealing ring 242 then constricts around the upper positioning groove 238 once the low valve stem 230 moves downward sufficiently to allow for contact between the upper positioning groove 238 and sealing ring 242. The low valve stem 230 contacts the chamber partition 222 to restrict air from flowing through the low partition hole 224. The medium valve stem 232 is pulled upward by hand with the handle 244 so that the sealing ring 242 of the medium valve stem 232 expands, disengaging the upper positioning groove 238 of the medium valve stem 232. The sealing ring 242 then constricts around the lower positioning groove 240 once the medium valve stem 232 moves upward sufficiently to allow for contact between the lower positioning groove 240 and sealing ring 242. This allows for a clearance between the medium valve stem 232 and chamber partition 222, allowing air to flow through the medium partition hole 226. The high valve stem 234 continues to prevent air from passing through the high partition hole 228. Due to the intermediate size of the medium partition hole 226, an amount of air passes from the upper inlet chamber 218 through the medium partition hole 226 to the lower inlet chamber 220 for each intake stroke of the piston 69 that is more than the amount that can pass when the valve mechanism 68*j* is set to the LOW compressor setting and less than the amount that can pass when the valve mechanism 68*j* is set to the HIGH compressor setting.

FIG. 19C depicts the valve mechanism 68*j* set to a HIGH compressor setting. The medium valve stem 232 is pushed downward by hand with the handle 244 so that the seal ring 242 of the medium valve stem 232 expands to disengage the lower positioning groove 240 of the medium valve stem 232. The sealing ring 242 then constricts around the upper positioning groove 238 once the medium valve stem 232 moves downward sufficiently to allow for contact between the upper positioning groove 238 and sealing ring 242. The medium valve stem 232 contacts the chamber partition 222 to restrict air from flowing through the medium partition hole 226. The high valve stem 234 is pulled upward by hand with the handle 244 so that the sealing ring 242 of the high valve stem 234 expands, disengaging the upper positioning groove 238 of the high valve stem 234. The sealing ring 242 then constricts around the lower positioning groove 240 once the high valve stem 234 moves upward sufficiently to allow for contact between the lower positioning groove 240 and sealing ring 242. This allows for a clearance between the high valve stem 234 and chamber partition 222, allowing air to flow through the high partition hole 228. The low valve stem 230 continues to prevent air from passing through the low partition hole 224. Due to the relatively large size of the high partition hole 228, an amount of air passes from the upper inlet chamber 218 through the high partition hole 228 to the lower inlet chamber 220 for each intake stroke of the piston 69 that is more than the amounts that can pass when the valve mechanism **68*j*** set to the LOW or MEDIUM compressor settings.

Since the low, medium, and high valve stems 230, 232, and 234 each require separate hand actuation, the valve mechanism **68*j* of FIGS. 19A-C may be limited in that the amount of air drawn during each intake stroke of the piston 69** may not be properly restricted if two or more of the valve stems are simultaneously opened. However, it will be appreciated that some embodiments will allow for a single, hand actuated valve stem in which multiple, incremental or non-incremental air flow levels are established by selectively positioning the valve stem at multiple positions with respect to a partition or intake hole. Other similar variations are also possible and are included within the contemplated scope of the invention.

Although the invention has been shown and described in the context of standard operating conditions of atmospheric pressure at sea level (approximately 14.7 PSI) and an environmental temperature of approximately 68 degrees Fahrenheit (20 degrees Celsius), it will be appreciated that actual performance of the invention will vary according to specific environmental factors and variations in the specific apparatuses used with the invention. It will be further appreciated that such variations are within the contemplated scope of the invention and that those skilled in the art will be able to recognize and account for such variations according to the specific apparatuses used and the actual operating conditions encountered during operation of the invention.

Those skilled in the art will recognize that the various features of this invention described above can be used in various combinations with other elements without departing from the scope of the invention. Thus, the appended claims are intended to be interpreted to cover such equivalent air compressor unit inlet controls as do not depart from the spirit and scope of the invention.

What is claimed is:

1. A method for controlling the amount of electric current from an electrical circuit that is used by an electric motor in a portable electric motor driven reciprocating air compressor unit comprising:

reciprocating a piston in a compression cylinder, the piston being driven with a portable electric motor;

channeling air into the compression cylinder through an inlet that is connected to the compression cylinder to allow the piston to draw and compress amounts of air during each reciprocation;

determining the amount of electric current that is used by the electric motor when each of a plurality of predeterminable amounts of air is permitted to be drawn into the compression cylinder and to be compressed by the piston during each reciprocation of the piston;

providing a valve mechanism that is mounted to the inlet and that is adjustable to a plurality of positions, each position of the valve mechanism allowing for one of the plurality of predeterminable amounts of air to be permitted to be drawn into the compression cylinder and to be compressed by the piston during each reciprocation of the piston; and manually adjusting the valve mechanism to control the amount of air that is drawn into the compression cylinder and then compressed by the piston to control the amount of electric current that is used by the electric motor.

2. The method of claim 1 further comprising adjusting the valve mechanism to cause the amount of air that is compressed with each compression stroke of the piston to increase to cause the amount of electric current that is used by the electric motor to increase.

3. The method of claim 1 further comprising adjusting the valve mechanism to cause the amount of air that is compressed with each compression stroke of the piston to decrease to cause the amount of electric current that is used by the electric motor to decrease.

4. The method of claim 1 further comprising adjusting the valve mechanism to one of a plurality of incremental positions, each incremental position corresponding to one of a plurality of predeterminable amounts of air to flow through the inlet for each intake stroke, each predeterminable amount of air drawn through the inlet corresponding to a predeterminable amount of air that is compressed with each compression stroke of the piston, each predeterminable amount of air that is compressed corresponding to one predeterminable current level from the electrical circuit that is used by the motor.

5. The method of claim 1 further comprising:

providing a filter on the manually controllable valve mechanism; and filtering particles from air that enters the air compressor unit through the valve mechanism.

6. The method of claim 1 further comprising hand operating the manually controllable valve mechanism to change the position of the valve mechanism.

7. The method of claim 1 further comprising hand operating the manually controllable valve mechanism with a hand-operated electric control that uses electric current to change the position of the valve mechanism.

8. The method of claim 1 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each compression stroke of the piston, each predeterminable amount of air that is compressed with each compression stroke of the piston corresponding to one predeterminable current level from the electrical circuit that is used by the motor;

providing a selector switch, the selector switch having a plurality of selection conditions, each selection condition corresponding to an incremental position of the manually controllable valve mechanism, the valve mechanism being responsive to each of the plurality of selection conditions of the selector switch, the valve mechanism using electric current to assume an incremental position when the selection condition to which the incremental position of the valve mechanism is responsive is manually selected; and manually controlling the incremental position of the manually controllable valve mechanism by hand operating the selector switch.

9. The method of claim 1 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each stroke of the piston, each predeterminable amount of air that is compressed with each stroke of the piston corresponding to one predeterminable current level from the electrical circuit that is used by the motor;

providing a plurality of solenoid controls, each solenoid control having an ON condition and an OFF condition, each solenoid control corresponding to one of the incremental positions of the manually controllable valve mechanism and corresponding to a predeterminable amount of air flow through the inlet, the manually controllable valve mechanism being responsive to the ON condition and the OFF condition of each solenoid control, the manually controllable valve mechanism being configured to assume one of the incremental positions when a solenoid control corresponding to the same incremental position assumes an ON condition;

providing a selector switch, the selector switch having a plurality of selection conditions, each selection condition corresponding to an incremental position of the manually controllable valve mechanism, each solenoid control being responsive to one of the plurality of the selection conditions of the selector switch wherein each solenoid control assumes an ON condition when the selection condition to which the solenoid control is responsive is manually selected, and each solenoid control assumes an OFF condition when the selection switch assumes a condition to which the solenoid control is not responsive; and manually controlling the incremental position of the manually controllable valve mechanism by moving the selector switch by hand to a selection condition.

10. A method for controlling the amount of electric current from an electrical circuit that is used by an electric motor in a portable electric motor driven reciprocating air compressor unit comprising:

causing an electric motor to reciprocate a piston within a compressor's chamber of the compressor unit;

channeling an amount of air into the compression cylinder through an inlet that is connected to the compression cylinder;

manually controlling the amount of air that flows through the inlet with a valve mechanism that is mounted to the inlet by adjusting the valve mechanism to one of a plurality of positions, each position of the valve mechanism allowing one of a plurality of predeterminable amounts of air to flow through the inlet into the compression cylinder for each reciprocation of the piston, at least two of said plurality of positions allowing said predeterminable amounts of air to be greater than zero;

manually adjusting the valve mechanism so that the amount of air that is compressed with each reciprocation of the piston increases to cause the amount of electric current that is used by the electric motor to increase; and manually adjusting the valve mechanism so that the amount of air that is compressed with each reciprocation of the piston decreases to cause the amount of electric current that is used by the electric motor to decrease.

11. The method of claim 10 further comprising adjusting the valve mechanism to one of a plurality of incremental positions, each incremental position corresponding to one of a plurality of predeterminable amounts of air to flow through the inlet for each intake stroke, each predeterminable amount of air drawn through the inlet corresponding to a predeterminable amount of air that is compressed with each compression stroke of the piston, each predeterminable amount of air that is compressed corresponding to one predeterminable current level from the electrical circuit that is used by the motor.

12. The method of claim 10 further comprising:

providing a filter on the manually controllable valve mechanism; and filtering particles from air that enters the air compressor unit through the valve mechanism.

13. The method of claim 10 further comprising hand operating the manually controllable valve mechanism to change the position of the valve mechanism.

14. The method of claim 10 further comprising hand operating the manually controllable valve mechanism with a hand-operated electric control that uses electric current to change the position of the valve mechanism.

15. The method of claim 10 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each compression stroke of the piston, each predeterminable amount of air that is compressed with each compression stroke of the piston corresponding to one predeterminable current level from the electrical circuit that is used by the motor;

providing a selector switch, the selector switch having a plurality of selection conditions, each selection condition corresponding to an incremental position of the manually controllable valve mechanism, the valve mechanism being responsive to each of the plurality of selection conditions of the selector switch, the valve mechanism using electric current to assume an incremental position when the selection condition to which the incremental position of the valve mechanism is responsive is manually selected; and manually controlling the incremental position of the manually controllable valve mechanism by hand operating the selector switch.

16. The method of claim 10 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each stroke of the piston, each predeterminable amount of air that is compressed with each stroke of the piston corresponding to one predeterminable current level from the electrical circuit that is used by the motor;

providing a plurality of solenoid controls, each solenoid control having an ON condition and an OFF condition, each solenoid control corresponding to one of the incremental positions of the manually controllable valve mechanism and corresponding to a predeterminable amount of air flow through the inlet, the manually controllable valve mechanism being responsive to the ON condition and the OFF condition of each solenoid control, the manually controllable valve mechanism being configured to assume one of the incremental positions when a solenoid control corresponding to the same incremental position assumes an ON condition;

providing a selector switch, the selector switch having a plurality of selection conditions, each selection condition corresponding to an incremental position of the manually controllable valve mechanism, each solenoid control being responsive to one of the plurality of the selection conditions of the selector switch wherein each solenoid control assumes an ON condition when the selection condition to which the solenoid control is responsive is manually selected, and each solenoid control assumes an OFF condition when the selection switch assumes a condition to which the solenoid control is not responsive; and manually controlling the incremental position of the manually controllable valve mechanism by moving the selector switch by hand to a selection condition.

17. A method for limiting the amount of current used by an electric motor in a portable electric motor driven reciprocating air compressor unit that is connected to an electrical circuit having a predeterminable current capacity to a level that is below the current capacity of the electrical circuit, the method comprising:

providing the electric motor driven portable compressor unit, the compressor unit having a compression cylinder and a piston, the piston being configured to be driven to reciprocate within the compression cylinder by the electric motor, the piston being configured to draw air into the compression cylinder through an inlet and then to compress and expel air that has been drawn into the compression cylinder through an outlet when the piston reciprocates;

causing the electric motor to draw electrical current from the electrical circuit, the compressor unit being configured to increase the amount of electric current used by the electric motor when the amount of air that is drawn by the piston during each reciprocation increases, the compressor unit being configured to decrease the amount of electric current used by the electric motor when the amount of air that is drawn by the piston during each reciprocation decreases;

providing a valve mechanism that is mounted to the inlet and that is manually adjustable to a plurality of positions, each position of the valve mechanism allowing for one of a plurality of predeterminable amounts of air to be compressed by the piston during each reciprocation of the piston, at least two of said plurality of positions allowing said predeterminable amounts of air to be greater than zero; and manually adjusting the valve mechanism to one of the plurality of positions that allows a sufficiently small amount of air to be drawn through the inlet during each reciprocation of the piston that the amount of electricity used by the electric motor during each reciprocation of the piston is below the current capacity of the electrical circuit.

18. The method of claim 17 further comprising adjusting the valve mechanism to one of a plurality of incremental positions, each incremental position corresponding to one of a plurality of predeterminable amounts of air to flow through the inlet for each intake stroke, each predeterminable amount of air drawn through the inlet corresponding to a predeterminable amount of air that is compressed with each compression stroke of the piston, each predeterminable amount of air that is compressed corresponding to one predeterminable current level from the electrical circuit that is used by the motor.

19. The method of claim 17 further comprising:

providing a filter on the manually controllable valve mechanism; and filtering particles from air that enters the air compressor unit through the valve mechanism.

20. The method of claim 17 further comprising hand operating the manually controllable valve mechanism to change the position of the valve mechanism.

21. The method of claim 17 further comprising hand operating the manually controllable valve mechanism with a hand-operated electric control that uses electric current to change the position of the valve mechanism.

22. The method of claim 17 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each compression stroke of the piston, each predeterminable amount of air that is compressed with each compression stroke of the piston corresponding to one predeterminable current level from the electrical circuit that is used by the motor;

providing a selector switch, the selector switch having a plurality of selection conditions, each selection condition corresponding to an incremental position of the manually controllable valve mechanism, the valve mechanism being responsive to each of the plurality of selection conditions of the selector switch, the valve mechanism using electric current to assume an incremental position when the selection condition to which the incremental position of the valve mechanism is responsive is manually selected; and manually controlling the incremental position of the manually controllable valve mechanism by hand operating the selector switch.

23. The method of claim 17 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each stroke of the piston, each predeterminable amount of air that is compressed with each stroke of the piston corresponding to one predeterminable current level from the electrical circuit that is used by the motor;

providing a plurality of solenoid controls, each solenoid control having an ON condition and an OFF condition, each solenoid control corresponding to one of the incremental positions of the manually controllable valve mechanism and corresponding to a predeterminable amount of air flow through the inlet, the manually controllable valve mechanism being responsive to the ON condition and the OFF condition of each solenoid control, the manually controllable valve mechanism being configured to assume one of the incremental positions when a solenoid control corresponding to the same incremental position assumes an ON condition;

providing a selector switch, the selector switch having a plurality of selection conditions, each selection condition corresponding to an incremental position of the manually controllable valve mechanism, each solenoid control being responsive to one of the plurality of the selection conditions of the selector switch wherein each solenoid control assumes an ON condition when the selection condition to which the solenoid control is responsive is manually selected, and each solenoid control assumes an OFF condition when the selection switch assumes a condition to which the solenoid control is not responsive; and manually controlling the incremental position of the manually controllable valve mechanism by moving the selector switch by hand to a selection condition.

24. A method for controlling the amount of electrical current used by an electric motor in a portable electric motor driven reciprocating air compressor unit that is connected to an electrical circuit having a predeterminable current capacity to control the amount of current that is available for use by devices other than the compressor unit that are also connected to the electrical circuit, the method comprising:

providing the electric motor driven portable compressor unit, the compressor unit having a compression cylinder and a piston, the piston being configured to be driven to reciprocate within the compression cylinder by the electric motor, the piston being configured to draw air into the compression cylinder through an inlet and then to compress and expel air that has been drawn into the compression cylinder through an outlet when the piston reciprocates;

causing the electric motor to draw electrical current from the electrical circuit, the compressor unit being configured to increase the amount of electrical current used by the electric motor when the amount of air that is drawn by the piston during each reciprocation increases, the compressor unit being configured to decrease the amount of electric current used by the electric motor when the amount of air that is drawn by the piston during each reciprocation decreases;

providing a valve mechanism that is mounted to the inlet and that is manually adjustable to a plurality of positions, each position of the valve mechanism allowing for one of a plurality of predeterminable amounts of air to be compressed by the piston during each reciprocation of the piston, at least two of said plurality of positions allowing said predeterminable amounts of air to be greater than zero;

determining the amount of air that is necessary to be compressed with each reciprocation of the piston for the compressor unit to service a load of compressed air-driven apparatuses that receive compressed air from the compressor unit;

determining the amount of electric current that is necessary for the electric motor to draw from the electrical circuit during each reciprocation of the piston to enable the piston to compress the amount of air that is necessary to service the load of air-driven apparatuses that receive compressed air from the compressor unit; and manually adjusting the valve mechanism to one of the plurality of positions that allows a sustaining amount of air to flow, for each reciprocation of the piston, that is at least sufficient to service the load of air-driven apparatuses that receive compressed air from the compressor unit, while causing the electric motor to draw only the amount of current from the electric circuit that is necessary to maintain the flow of the sustaining amount of air by the compressor unit.

25. The method of claim 24 further comprising adjusting the valve mechanism to one of a plurality of incremental positions, each incremental position corresponding to one of a plurality of predeterminable amounts of air to flow through the inlet for each intake stroke, each predeterminable amount of air drawn through the inlet corresponding to a predeterminable amount of air that is compressed with each compression stroke of the piston, each predeterminable amount of air that is compressed corresponding to one predeterminable current level from the electrical circuit that is used by the motor.

26. The method of claim 24 further comprising:

providing a filter on the manually controllable valve mechanism; and filtering particles from air that enters the air compressor unit through the valve mechanism.

27. The method of claim 24 further comprising hand operating the manually controllable valve mechanism to change the position of the valve mechanism.

28. The method of claim 24 further comprising hand operating the manually controllable valve mechanism with a hand-operated electric control that uses electric current to change the position of the valve mechanism.

29. The method of claim 24 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each compression stroke of the piston, each predeterminable amount of air that is compressed with each compression stroke of the piston corresponding to one predeterminable current level from the electrical circuit that is used by the motor;

providing a selector switch, the selector switch having a plurality of selection conditions, each selection condition corresponding to an incremental position of the manually controllable valve mechanism, the valve mechanism being responsive to each of the plurality of selection conditions of the selector switch, the valve mechanism using electric current to assume an incremental position when the selection condition to which the incremental position of the valve mechanism is responsive is manually selected; and manually controlling the incremental position of the manually controllable valve mechanism by hand operating the selector switch.

30. The method of claim 24 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each stroke of the piston, each predeterminable amount of air that is compressed with each stroke of the piston corresponding to one predeterminable current level from the electrical circuit that is used by the motor;

providing a plurality of solenoid controls, each solenoid control having an ON condition and an OFF condition, each solenoid control corresponding to one of the incremental positions of the manually controllable valve mechanism and corresponding to a predeterminable amount of air flow through the inlet, the manually controllable valve mechanism being responsive to the ON condition and the OFF condition of each solenoid control, the manually controllable valve mechanism being configured to assume one of the incremental positions when a solenoid control corresponding to the same incremental position assumes an ON condition;

providing a selector switch, the selector switch having a plurality of selection conditions, each selection condition corresponding to an incremental position of the manually controllable valve mechanism, each solenoid control being responsive to one of the plurality of the selection conditions of the selector switch wherein each solenoid control assumes an ON condition when the selection condition to which the solenoid control is responsive is manually selected, and each solenoid control assumes an OFF condition when the selection switch assumes a condition to which the solenoid control is not responsive; and manually controlling the incremental position of the manually controllable valve mechanism by moving the selector switch by hand to a selection condition.

31. A method for controlling the number of devices that can be connected to an electrical circuit having a predeterminable current capacity by controlling the amount of current used by an electric motor in a portable electric motor driven reciprocating air compressor unit that is connected to the electrical circuit, the method comprising:

providing the electric motor driven portable compressor unit, the compressor unit having a compression cylinder and a piston, the piston being configured to be driven to reciprocate within the compression cylinder by the electric motor, the compression cylinder being configured to draw air into the compression cylinder through an inlet and then to compress and expel air that has been drawn into the compression cylinder through an outlet when the piston reciprocates, providing a valve mechanism that is mounted to the inlet and that is manually adjustable to a plurality of positions, each position of the valve mechanism allowing for one of the plurality of predetermined amounts of air to be permitted to be drawn into the compression cylinder and to be compressed by the piston during each reciprocation of the piston;

causing the electric motor to draw electrical current from the electrical circuit;

determining the amount of electrical current that is necessary to operate the devices other than the compressor unit that are to be connected to the electrical circuit; and manually controlling with the valve mechanism the amount of air that is drawn through the inlet and compressed during each reciprocation of the piston to control the amount of electric current that is used by the electric motor to drive the piston and to restrict the amount of electrical current used by the electric motor to a level that is necessary to allow for sufficient remaining current in the electrical circuit to operate the devices other than the compressor unit that are also connected to the electrical circuit.

32. The method of claim 31 further comprising adjusting the valve mechanism to one of a plurality of incremental positions, each incremental position corresponding to one of a plurality of predeterminable amounts of air to flow through the inlet for each intake stroke, each predeterminable amount of air drawn through the inlet corresponding to a predeterminable amount of air that is compressed with each compression stroke of the piston, each predeterminable amount of air that is compressed corresponding to one predeterminable current level from the electrical circuit that is used by the motor.

33. The method of claim 31 further comprising:

providing a filter on the manually controllable valve mechanism; and filtering particles from air that enters the air compressor unit through the valve mechanism.

34. The method of claim 31 further comprising hand operating the manually controllable valve mechanism to change the position of the valve mechanism.

35. The method of claim 31 further comprising hand operating the manually controllable valve mechanism with a hand-operated electric control that uses electric current to change the position of the valve mechanism.

36. The method of claim 31 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each compression stroke of the piston, each predeterminable amount of air that is compressed with each compression stroke of the piston corresponding to one predeterminable current level from the electrical circuit that is used by the motor;

providing a selector switch, the selector switch having a plurality of selection conditions, each selection condition corresponding to an incremental position of the manually controllable valve mechanism, the valve mechanism being responsive to each of the plurality of selection conditions of the selector switch, the valve mechanism using electric current to assume an incremental position when the selection condition to which the incremental position of the valve mechanism is responsive is manually selected; and manually controlling the incremental position of the manually controllable valve mechanism by hand operating the selector switch.

37. The method of claim 31 further comprising:

providing a plurality of incremental positions on the manually controlled valve mechanism, each incremental position corresponding to one of a plurality of predeterminable amounts of air to flow through the inlet, each predeterminable amount of air flowing through the inlet corresponding to a predeterminable amount of air that is compressed with each stroke of the piston, each predeterminable amount of air that is compressed with each stroke of the piston corresponding to one predeterminable current level from the electrical circuit that is used by the motor;

providing a plurality of solenoid controls, each solenoid control having an ON condition and an OFF condition, each solenoid control corresponding to one of the incremental positions of the manually controllable valve mechanism and corresponding to a predeterminable amount of air flow through the inlet, the manually controllable valve mechanism being responsive to the ON condition and the OFF condition of each solenoid control, the manually controllable valve mechanism being configured to assume one of the incremental positions when a solenoid control corresponding to the same incremental position assumes an ON condition;

providing a selector switch, the selector switch having a plurality of selection conditions, each selection condition corresponding to an incremental position of the manually controllable valve mechanism, each solenoid control being responsive to one of the plurality of the selection conditions of the selector switch wherein each solenoid control assumes an ON condition when the selection condition to which the solenoid control is responsive is manually selected, and each solenoid control assumes an OFF condition when the selection switch assumes a condition to which the solenoid control is not responsive; and manually controlling the incremental position of the manually controllable valve mechanism by moving the selector switch by hand to a selection condition.

* * * * *